US007424802B2

(12) United States Patent
Yatsuzuka et al.

(10) Patent No.: US 7,424,802 B2
(45) Date of Patent: Sep. 16, 2008

(54) STEAM ENGINE

(75) Inventors: Shinichi Yatsuzuka, Chiryu (JP); Shuzo Oda, Kariya (JP); Yasumasa Hagiwara, Kariya (JP); Toshiyuki Morishita, Nagoya (JP); Katsuya Komaki, Kariya (JP)

(73) Assignee: Denso Corporation, Kariya (JP)

( * ) Notice: Subject to any disclaimer, the term of this patent is extended or adjusted under 35 U.S.C. 154(b) by 565 days.

(21) Appl. No.: 11/132,653

(22) Filed: May 19, 2005

(65) Prior Publication Data

US 2005/0257524 A1 Nov. 24, 2005

(30) Foreign Application Priority Data

May 19, 2004 (JP) ..... 2004-149599
May 19, 2004 (JP) ..... 2004-149600
May 19, 2004 (JP) ..... 2004-149601

(51) Int. Cl.
*F01B 1/00* (2006.01)
*F01K 13/00* (2006.01)

(52) U.S. Cl. ..... 60/508; 60/659; 60/670

(58) Field of Classification Search ..... 60/508, 60/514, 515, 645, 659, 670
See application file for complete search history.

(56) References Cited

U.S. PATENT DOCUMENTS 6,976,360 B1 * 12/2005 Yatsuzuka et al. ..... 60/645
7,073,331 B2 * 7/2006 Oda et al. ..... 60/508
7,185,491 B2 * 3/2007 Oda et al. ..... 60/508
2004/0060294 A1 4/2004 Yatsuzuka et al.

FOREIGN PATENT DOCUMENTS

JP 58-057014 4/1983

OTHER PUBLICATIONS

Office Action dated Feb. 9, 2007 in Chinese Application No. 2005-100727587 with English translation.

* cited by examiner

*Primary Examiner*—Hoang M Nguyen
(74) *Attorney, Agent, or Firm*—Harness, Dickey & Pierce, PLC

(57) ABSTRACT

A steam engine has a pipe shaped fluid container, a heating and cooling devices respectively provided at a heating and cooling portions of the fluid container, and an output device connected to the fluid container, so that the output device is operated by the fluid pressure change in the fluid container, to generate an electric power. In such a steam engine, an inner radius "r1" of the cooling portion is made to almost equal to a depth "δ1" of thermal penetration, which is calculated by the following formula (1);

$$\delta_1 = \sqrt{\frac{2a_1}{\omega}} \quad (1)$$

wherein, "a1" is a heat diffusivity of the working fluid at its low pressure, and "ω" is an angular frequency of the movement of the working fluid.

8 Claims, 16 Drawing Sheets

STEAM ENGINE

CROSS REFERENCE TO RELATED APPLICATION

This application is based on Japanese Patent Application Nos. 2004-149599, 2004-149600, and 2004-149601, each of which is filed on May 19, 2004, the disclosures of which are incorporated herein by reference.

FIELD OF THE INVENTION

The present invention relates to a steam engine having a fluid container, in which working fluid is filled and the working fluid is vibrated in the fluid container in a self-excited vibrating manner as a result of a repeated operation of vaporization and liquefaction of the working fluid by heating and cooling the working fluid. A mechanical energy is generated at an output device of the steam engine, which is operated by the fluid vibration in the fluid container.

BACKGROUND OF THE INVENTION

An apparatus for a steam engine is known in the art, for example as disclosed in Japanese Patent Publication No. S58-057014, in which working fluid is filled in a fluid container, the working fluid is heated and vaporized by a heating device, and the working fluid is cooled down and liquefied by a cooling device, and in which energy is obtained by repeating vaporization and liquefaction of the working fluid.

Namely, a mechanical energy is obtained in the above steam engine at an output device, which is operated by pressure change of the working fluid in the fluid container, wherein the pressure change is generated by change of state (vaporization and liquefaction) of the working fluid.

The inventors of the present invention have applied for another patent relating to a steam engine in Japanese Patent Office, which is published as a publication number of 2004-84523.

A structure of the steam engine 500 of the prior patent application is shown in FIG. 24.

The steam engine 500 comprises a U-shaped fluid container 502 in which working fluid is filled, a heating device 504 for heating the working fluid in the fluid container 502, a cooling device 506 for cooling down and liquefying steam generated by the heat at the heating device 504, and an output device 508.

The output device 508 comprises a cylinder 510, a piston 512 reciprocating in the cylinder 510, a moving shaft 514 connected at its one end with the piston 512, and a spring 516 connected to the other end of the moving shaft 514, wherein the piston 512 is reciprocated in the cylinder 510 by receiving fluid pressure of the working fluid in the fluid container 502.

In the above steam engine 500, a volumetric expansion of the working fluid (steam) is generated, when the working fluid in the fluid container 502 is heated and vaporized by the heating device 504. The generated steam moves downwardly in the container 502 and is cooled down and liquefied by the cooling device 506. Then, the volume of the working fluid in the fluid container 502 is contracted. The piston 512 and the moving shaft 514 of the output device 508 receive the pressure change generated in the fluid container 502 due to the volumetric expansion and contraction of the working fluid, and thereby the piston 512 is reciprocated.

When a permanent magnet is provided to the moving shaft 514 and an electromagnetic coil is arranged to face to the magnet, an electromotive force is generated in the coil in accordance with the reciprocal movement of the piston 512 and the moving shaft 514, and an electric power is generated.

The above steam engine has, however, some disadvantages or problems as described below:

(1) At first, output energy of the steam engine would become smaller, when a cross sectional area of a cooling portion of the fluid container, at which the steam of the working fluid is liquefied, is not properly designed.

For example, in the case that a cross sectional area of the cooling portion of the fluid container (at which the cooling device is provided) is made extremely small, a heat transfer time for transferring the heat in a cross sectional direction, from an inner surface of the cooling portion to a center of the working fluid in the fluid container, becomes shorter. As a result, a cooling efficiency for the working fluid at the cooling portion becomes higher, so that gas-phase working fluid (the steam) is liquefied within a very short time.

In such a steam engine, the steam generated at the heating device moves toward the cooling device, and the steam is liquefied at once at the cooling portion. A volumetric expansion of the working fluid is suppressed to a small amount, to reduce the output energy at the steam engine. A p-v diagram of the above case is shown in FIG. 23B, wherein a relation between the pressure and volume of the working fluid is indicated by a solid line.

FIG. 23A shows a p-v diagram in the case that the vaporization and liquefaction of the working fluid is properly performed, and the desired value of FIG. 23A is indicated by a dotted line in FIGS. 23B and 23C. As shown in FIG. 23B, an area of the p-v diagram becomes smaller than that of the desired value, and the output energy is correspondingly decreased.

On the other hand, in the case that a cross sectional area of the cooling portion of the fluid container is made extremely large, the heat transfer time for transferring the heat from the inner surface of the cooling portion to the center of the working fluid, becomes longer. As a result, the cooling efficiency for the working fluid at the cooling portion is decreased, so that a longer timer is necessary for liquefying the gas-phase working fluid (the steam).

In such a case, even when the steam generated by the heating device moves to the cooling device, the gas-phase working fluid is maintained for a longer period and the fluid pressure in the fluid container remains at a high value, due to the longer period for the liquefaction. As a result, an area of the p-v diagram becomes smaller, as shown in FIG. 23C, to likewise decrease the output energy. Furthermore, when the gas-phase working fluid remains at the heating device, the liquid-phase working fluid can be hardly vaporized. As a result, the fluid pressure by the vaporization can not be increased, and thereby the operation of the steam engine may be irregularly stopped.

Furthermore, in the case that a cross sectional area of a connecting passage portion of the fluid container (which is a passage portion between the heating device and the cooling device) is made small, the heat transfer time for transferring the heat in a cross sectional direction, from the inner surface of the connecting passage portion to the center of the working fluid in the fluid container, becomes shorter. As a result, the cooling efficiency for the working fluid at the connecting passage portion becomes higher.

In such a case, the steam generated at the heating device is liquefied at the connecting passage portion, when the steam is moved toward the cooling device. A volumetric expansion of the working fluid by the vaporization is suppressed to a small amount, to reduce the output energy at the steam engine, as shown by the p-v diagram of FIG. 23B.

(2) It is necessary not only to increase input energy to the steam engine but also to increase amount of heat exchange to be transferred from the heating and cooling devices to the working fluid, in order to increase the output mechanical energy to be generated at the steam engine. It can be possible to increase the amount of the heat exchange, for example, by setting a temperature of the heating device at a higher value and by setting a temperature of the cooling device at a lower value.

It is, however, inevitably necessary, in the above method of increasing the temperature at the heating device and decreasing the temperature of the cooling device, to increase the input energy to the heating and cooling devices. The output mechanical energy obtained by the steam engine is thereby increased on one hand, but energy loss would be adversely become larger on the other hand, if energy transfer effectiveness from the heat energy to the mechanical energy is low.

The mechanical energy to be generated at the steam engine can be increased by increasing surface areas of a heating and a cooling portion of the fluid container at the respective heating and cooing devices, without changing (increasing or decreasing) preset temperatures of the heating and cooling devices.

In the case that cross sectional areas of the heating and cooling portions of the devices are simply enlarged to increase the surface areas, the heat transfer time in the cross sectional direction of the fluid container, from the inner surface to the center of the working fluid, becomes longer. The heating efficiency and cooling efficiency at the respective heating and cooling portions are thereby decreased, so that the energy transfer effectiveness can not be sufficiently improved. As a result, the mechanical energy can not be sufficiently generated at the steam engine.

(3) In the steam engine 500 shown in FIG. 24, the heating device 504 is so formed to surround the heating portion of the fluid container 502, so that it heats the working fluid in the fluid container 502 from its outer periphery. It is, however, a problem in such steam engine that the heating efficiency is not sufficiently high.

In the heating device 504 as above, namely in which the working fluid is heated from the outer periphery of the fluid container 502, there is a temperature gradient, as shown in FIG. 25. The temperature of the working fluid becomes lower, as a distance from the heating device 504 is longer.

Accordingly, the working fluid in the fluid container 502 consists of "gas-phase (steam) working fluid being vaporized" and "liquid-phase working fluid heated but not vaporized", as a result of heating operation by the heating device 504. The liquid-phase working fluid, which moves toward the cooling device 506 together with the steam, is cooled down by the cooling device 506, without contributing in the fluid vibration (expansion and contraction of the working fluid). Therefore, the steam engine of this kind has a larger heat loss.

SUMMARY OF THE INVENTION

The present invention is made in view of the above problems. It is an object of the present invention to provide a steam engine, in which working fluid in a fluid container is vibrated in an appropriate vibrating manner as a result of a repeated operation of vaporization and liquefaction of the working fluid, to prevent a decrease of output mechanical energy.

It is a further object of the present invention to provide a steam engine, in which energy transfer effectiveness is improved to increase the output mechanical energy.

It is a still further object of the present invention to provide a steam engine, in which heating and cooling efficiency are increased.

According to a feature of the present invention, a steam engine has a pipe shaped fluid container in which a working fluid is filled, a heating device and a cooling device respectively provided at a heating portion and a cooling portion of the fluid container, and an output device connected to the fluid container so that the output device is operated by the fluid pressure change in the fluid container to generate an energy (electric power), wherein the working fluid is vaporized and liquefied by the heating and cooling device to generate a fluid vibration by the volumetric change of the working fluid. In such a steam engine, an inner radius "r1" of the cooling portion is made to be almost equal to a depth "δ1" of thermal penetration (at a low pressure), which is calculated by the following formula (1);

$$\delta_1 = \sqrt{\frac{2a_1}{\omega}} \tag{1}$$

wherein, "a1" is a heat diffusivity of the working fluid at its low pressure, and "ω" is an angular frequency of the movement of the working fluid in the fluid container, and wherein the heat diffusivity "a1" is selected from those values corresponding to a pressure variable range of the working fluid, which is a range of the fluid pressure from the lower limit to a fluid pressure higher than the lower limit by 25%.

According to another feature of the present invention, the fluid container further comprises a connecting portion for connecting the heating portion with the cooling portion, wherein an inner radius "r2" of the connecting portion is made to satisfy the following formulas (2) and (3);

$$\frac{(r_2)^2}{2 \cdot a_2} = \tau \tag{2}$$

$$\omega \cdot \tau \geq 10 \tag{3}$$

wherein, "a2" is a heat diffusivity of the working fluid at its high pressure, and "ω" is an angular frequency of the movement of the working fluid in the fluid container.

According to a further feature of the present invention, in a steam engine having the pipe shaped fluid container, the heating and cooling devices respectively provided at the heating and cooling portions of the fluid container, and the output device connected to the fluid container, each of the heating portion and the cooling portion comprises multiple small pipe portions.

According to a still further feature of the present invention, in a steam engine having the pipe shaped fluid container, the heating and cooling devices respectively provided at the heating and cooling portions of the fluid container, and the output device connected to the fluid container, the heating device is arranged to be vertically higher than the cooling device, a gas is filled in the fluid container at the heating portion so that the inner space of the heating portion is not filled with the liquid-phase working fluid, and a working fluid supply means is provided at the heating portion to supply the liquid-phase working fluid to the heating portion.

The working fluid supply means comprises multiple narrow grooves and/or multiple micro grooves formed at an inner surface of the heating portion. The working fluid supply means can be alternatively formed by a water-attracting surface formed at the inner surface of the heating surface.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

A first embodiment of the present invention will now be explained with reference to the drawings.

Figure 1:
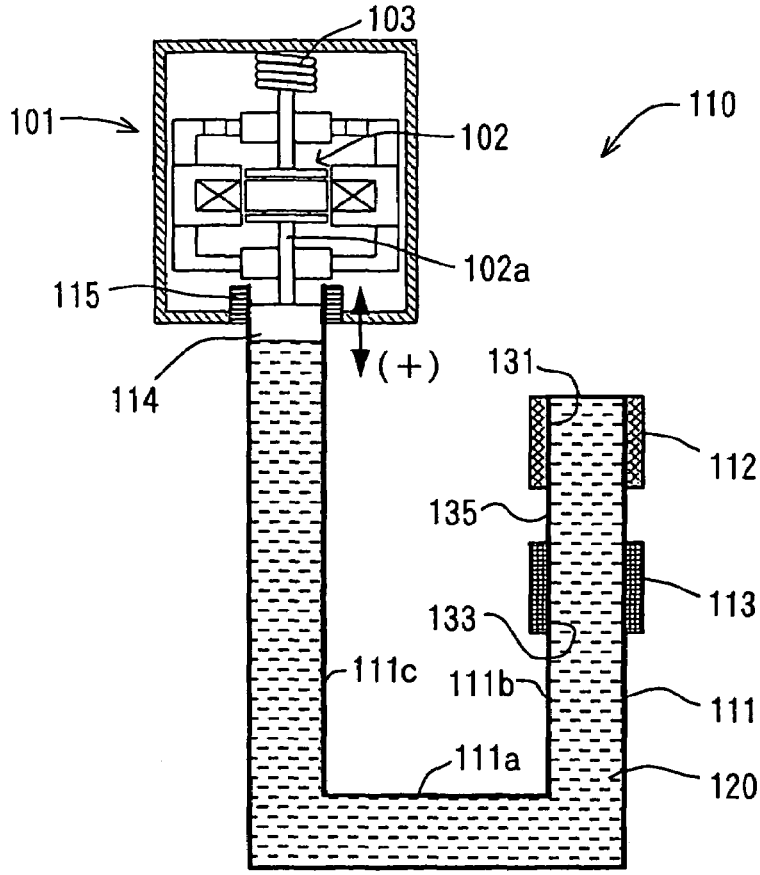
FIG. 1 is a schematic view showing a steam engine according to a first embodiment of the present invention.

In the first embodiment shown in FIG. 1, a steam engine 110 is applied to a linear motor, in which a moving member 102 of an output device (an electric power generator) 101 is vibrated. An electric power device comprises the steam engine 110 and the electric power generator 101.

The electric power generator 101 is a linear vibration generator, in which a permanent magnet (not shown) is fixed to the moving member 102 and electromotive force is generated by vibrating (oscillating) the moving member 102.

As shown in FIG. 1, the steam engine 110 comprises a fluid container 111 in which working fluid 120 is filled with a predetermined pressure, a heating device 112 for heating the working fluid 120 in the fluid container 111, and a cooling device 113 for cooling down steam generated at the heating device 112.

The heating device 112 and the cooling device 113 are arranged to be separated from each other, so that the heating and cooling devices are not directly contacted with each other.

In the case that the steam engine 110 is used for a water-cooling type internal combustion engine, the heating device 112 can be designed as a heating device, which heats the working fluid 120 by use of exhaust gas emitted from the internal combustion engine. And the cooling device 113 can be designed as a cooling device, which cools down the working fluid 120 by use of engine cooling water.

The fluid container 111 is formed into a U-shaped pipe having a bottom pipe portion 111*a* and a pair of (first and second) vertically extending straight pipe portions 111*b* and 111*c* extending from both ends of the bottom pipe portion 111*a*.

The first straight pipe portion 111*b* comprises a heating portion 131 at which the heating device 112 is provided, a cooling portion 133 at which the cooling device 113 is provided, and a connecting portion 135 for connecting the above heating and cooling portions 131 and 133 with each other.

The heating and cooling portions 131 and 133 of the fluid container 111 are made of such metal having a high heat conductivity, whereas the other portion of the fluid container 111 is preferably made of such material having a high heat insulating characteristic. The fluid container 111 is further made of such material, which has a high anti-corrosion characteristic with respect to the working fluid filled in the fluid container 111.

In the embodiment, water is used as the working fluid 120, and the heating and cooling portions 131 and 133 of the fluid container 111 are made of copper or aluminum, whereas the other portion is made of stainless steel.

As described above, the fluid container 111 is made of the stainless steel and the copper (or the aluminum) and formed into the U-shaped pipe, wherein the bottom pipe portion 111*a* is arranged at a lower most position and two straight pipe portions 111*b* and 111*c* are vertically and upwardly extending from the bottom pipe portion 111*a*.

The heating portion 131 of the fluid container 111 is formed at a position vertically higher than that of the cooling portion 133, and a top end of the first straight pipe portion is closed.

The heating device 112 is provided to the first pipe portion to surround the heating portion 131, whereas the cooling device 113 is provided to the first pipe portion to surround the cooling portion 133.

A piston 114 is provided at a top end of the second pipe portion 111*c*, at which the piston 114 is movably held in a cylinder 115 to move up and down in accordance with the fluid pressure.

The piston 114 is connected to the moving shaft 102*a* of the moving member 102 in the output device 101. A spring 103 is provided in the output device 101 between the moving member 102 and an end opposite to the moving member 102, so that it downwardly urges the piston 114 by its spring force.

Figure 2:
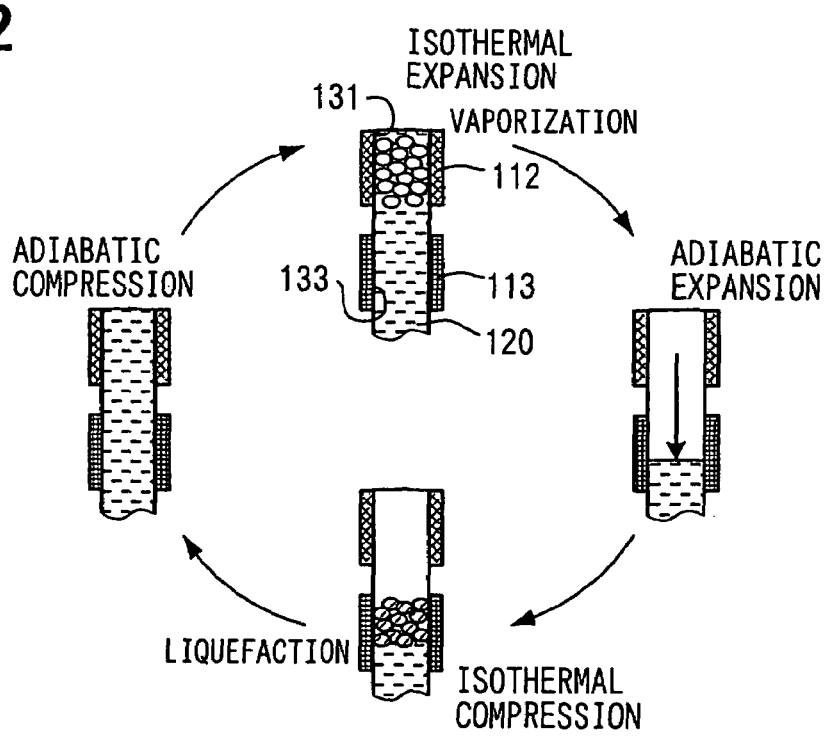
FIG. 2 is a schematic view showing a principle of operation of the steam engine.

When the heating and cooling devices 112 and 113 of the steam engine 110 start its operation, as shown in FIG. 2, the liquid-phase working fluid in the fluid container 111 is at first heated at the heating device 112 and vaporized (isothermal expansion). The vaporized working fluid (steam) is further expanded (adiabatic expansion), to push down the liquid-phase working fluid in the first pipe portion 111*b*. The liquid-phase working fluid 120 is moved in the fluid container 111 from the first pipe portion 111*b* toward the second pipe portion 111*c*, to move up the piston 114.

A liquid surface (between the liquid-phase and gas-phase working fluid) of the working fluid in the first pipe portion 111*b* is pushed down to the cooling portion 133 of the cooling device 113. When the steam enters into the cooling portion 133, the steam is cooled down and liquefied by the cooling device 113. The pressure for downwardly pushing the liquid-phase working fluid in the first pipe portion 111*b* disappears and thereby the liquid surface is moved up in the first pipe portion 111*b* (in a process from the isothermal compression to the adiabatic compression). The piston 114 of the power generator 101 is correspondingly moved down.

The above operation of the expansion and contraction of the working fluid continues until the stop of the heating and cooling devices 112 and 113, during which the working fluid 120 in the fluid container 111 is periodically vibrated (in a self-excited vibrating manner). As above, the pressure change of the working fluid 120 is generated in the steam engine 110, and the pressure change is converted into the mechanical energy to move up and down the piston 114.

In the above steam engine 110, the high temperature and high pressure working fluid (the steam) is not directly brought into contact with the piston 114. The steam engine 110 has therefore a high durability.

The cooling portion 133 of the fluid container 111 is so designed that an inner radius "r1" of the cooling portion 133 is made equal to a depth "δ1" of thermal penetration (at a low pressure), which is calculated by the following formula (1):

$$\delta_1 = \sqrt{\frac{2a_1}{\omega}} \tag{1}$$

Figure 3:
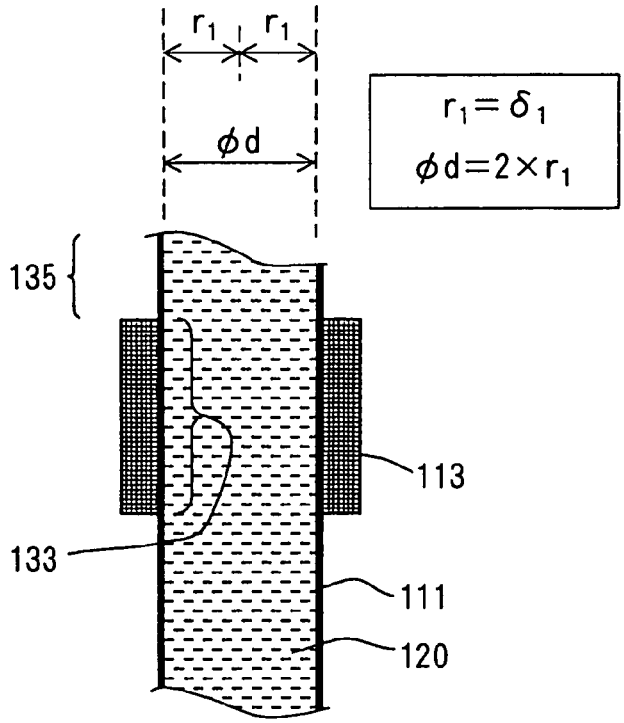
FIG. 3 is a schematic cross sectional view showing a cooling device of the first embodiment.

FIG. 3 shows an enlarged cross sectional view of the cooling portion 133 of the fluid container 111, wherein "ϕd" is an inner diameter of the cooling portion 133, and "r1" is the inner radius thereof.

In the above formula (1), "a1" is a heat diffusivity [m2/sec.] of the working fluid 120 at the low pressure, and "ω" is an angular frequency [rad/sec.] representing a characteristic of the working fluid 120 in the fluid container 111 (i.e. representing a characteristic of a reciprocating movement of the piston 114).

A heat diffusivity of the working fluid, in which the fluid pressure of the working fluid 120 in the fluid container 111 is at its lower limit, is used as the heat diffusivity "a1". The inside fluid pressure of the fluid container 111 varies depending on the change of state (vaporization and liquefaction) of the working fluid. Namely, the heat diffusivity "a1" is a value, when the inside fluid pressure is at the smallest value in a pressure variable range (a pressure range from the maximum to the minimum value of the fluid pressure of the working fluid 120). And the depth "δ1" of thermal penetration (at a low pressure) is defined as a value, which is calculated from the formula (1), wherein the above heat diffusivity "a1" is used.

The depth "δ1" of thermal penetration is one of parameters for representing a heat transferring condition in the working fluid, which is vibrated in the fluid container at the angular frequency of "ω". An amount of heat exchange at the cooling portion 133 between the working fluid 120 and the cooling device 113 can be controlled at a predetermined range, when the inner radius "r1" of the fluid container 111 is designed to be equal to the depth "δ1" of thermal penetration (at the low pressure).

According to the steam engine 110 of the present invention, the cooling efficiency at the cooling portion 133 is prevented from becoming extremely high or low, and thereby the gas-phase working fluid (the steam) can be liquefied at a proper timing.

In particular, since the heat diffusivity of the working fluid 120, in which the fluid pressure of the working fluid 120 in the fluid container 111 is at its lower limit, is used as the heat diffusivity "a1" in the steam engine 110 of the present embodiment, the cooling efficiency becomes maximum at such a timing at which the inside fluid pressure of the fluid container 111 (the pressure of the working fluid 120) becomes at its lower limit. Namely, the gas-phase working fluid 120 can be liquefied most efficiently when the volume of the working fluid 120 becomes at its maximum value, so that the expansion energy of the working fluid can be utilized without energy loss.

As described above, the gas-phase working fluid (the steam) can be liquefied at a proper timing, according to the steam engine 110 of the present embodiment. The working fluid 120 can be properly vibrated, to prevent the decrease of the output energy at the output device 101 generated by the reciprocal movement of the piston 114. And furthermore, since the liquefaction of the gas-phase working fluid 120 is not extremely delayed, the steam engine 110 is prevented from its irregular shut-down due to the stop of the fluid vibration in the fluid container 111.

According to the above embodiment, an inner radius "r2" of the connecting portion 135 of the fluid container 111 is further so designed that the following formulas (2) and (3) are satisfied:

$$\frac{(r_2)^2}{2 \cdot a_2} = \tau \tag{2}$$

$$\omega \cdot \tau \geq 10 \tag{3}$$

Figure 4:
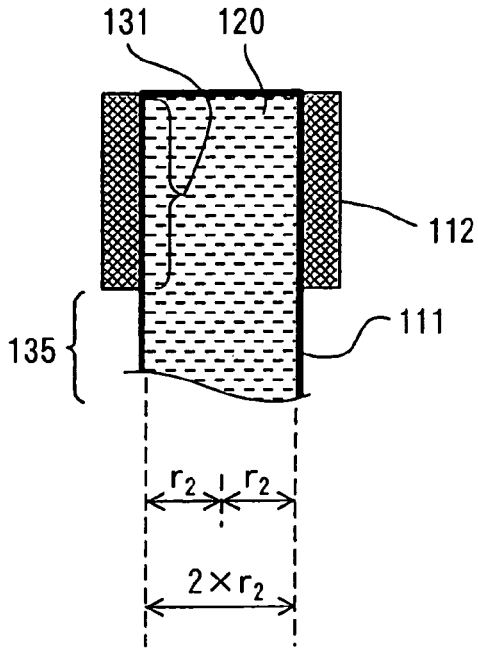
FIG. 4 is a schematic cross sectional view showing a heating device of the first embodiment.

FIG. 4 shows an enlarged cross sectional view of the heating portion 131 and the connecting portion 135 of the fluid container 111, wherein "r2" is an inner radius of the connecting portion 135.

In the above formula (2), "a2" is a heat diffusivity of the working fluid at high pressure, wherein the high pressure means an upper limit of the fluid pressure in the pressure variable range. Namely, the heat diffusivity "a2" (at the high pressure) is a value of the heat diffusivity of the working fluid, when the fluid pressure in the fluid container is at its maximum value.

Figure 5:
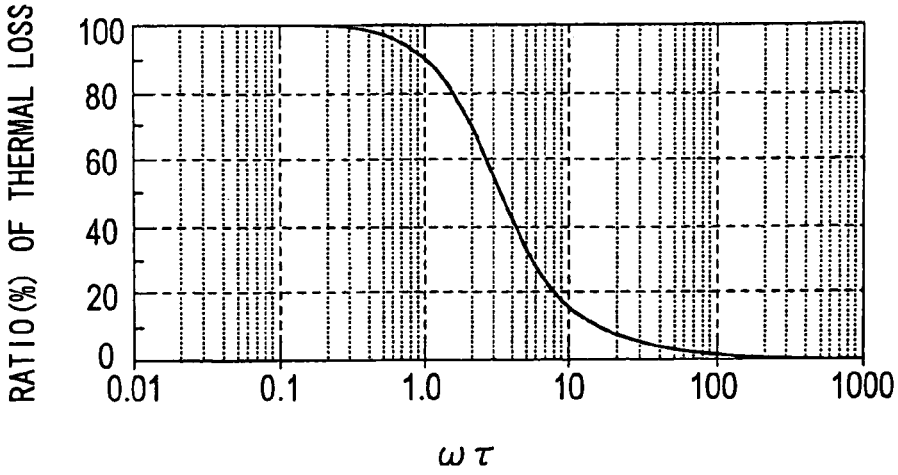
FIG. 5 is a graph showing a relation between energy loss and a parameter "ωτ"

FIG. 5 shows a relation between a left part "ωτ" of the formula (3) and a ratio of thermal loss, which would occur by a heat transfer from the working fluid 120 to the connecting portion 135. As seen from FIG. 5, the ratio of the thermal loss is decreased as the value of "ωτ" is increased.

In FIG. 5, the ratio of the thermal loss is about 16%, when the value of "ωτ" is "10". The thermal loss at the connecting portion 135 of the steam engine 110 can be surely suppressed to a value smaller than 20%, because the inner radius "r2" of the connecting portion 135 is designed to meet the formulas (2) and (3), wherein "ωτ" is larger than "10".

As a result that the ratio of the thermal loss at the connecting portion 135 is made to be smaller than 20%, the gas-phase working fluid (the steam) 120 is prevented from being liquefied at the connecting portion 135. The steam of the working fluid 120 can be liquefied at the cooling portion 133, so that a sufficient amount of the volumetric expansion of the working fluid can be obtained in the fluid container 111.

The inside fluid pressure of the working fluid 120 in the fluid container 111 can be sufficiently increased to a high value, to effectively operate the piston and thereby to prevent the decrease of the output energy generated at the output device 101.

As shown in FIG. 4, an inner radius of the heating portion 131 is designed to be equal to the inner radius "r2" of the connecting portion 135. Namely, the inner surface of the heating portion 131 is smoothly connected, without any step portion, to the inner surface of the connecting portion 135, so that the movement of the working fluid 120 between the heating portion 131 and the connecting portion 135 can be smoothly done.

Any energy loss of the working fluid, which could be generated when the working fluid is moved from the heating portion 131 to the connecting portion 135 in case that the step portion is formed therebetween, can be prevented. The possible decrease of output energy at the output device 101 can be accordingly prevented.

As shown in FIG. 3 or FIG. 1, the inner radius of the heating portion 131, as well as the inner radius "r1" of the cooling portion 133 is designed to be equal to the inner radius "r2" of the connecting portion 135. Namely, the inner surfaces of the heating and cooling portions 131 and 133 and the inner surface of the connecting portion 135 are smoothly connected to each other, so that the working fluid 120 can be smoothly moved in the fluid container 111.

The inner radius of the heating and/or cooling portions 131 and 133, however, is not necessarily designed to be exactly equal to that of the connecting portion 135. The smooth movement of the working fluid 120 in the fluid container 111 can be obtained, when the inner radius of heating and/or cooling portions 131 and 133 is designed to be close to (almost equal to) the inner radius of the connecting portion 135.

The present invention shall not be limited to the above described embodiment, but any modifications can be possible within the meaning of the present invention.

In the above embodiment, for example, the heat diffusivity "a1" is defined as the value, when the inside fluid pressure is at the smallest value (the lower limit) in the pressure variable range. When a pressure range from the lower limit of the pressure variable range to a value, which is higher than the lower limit by 25% of the whole pressure variable range, is defined as a low pressure range, the heat diffusivity "a1" can be selected from any one of the heat diffusivities in the low pressure range, so that the gas-phase working fluid can be vaporized at proper timings.

Accordingly, in the fluid container 111 in which the inner radius "r1" of the cooling portion 133 is designed to be equal or almost equal to the depth "δ1" of thermal penetration (at the low pressure range) and the depth "δ1" is calculated from the formula (1) with the heat diffusivity "a1" (at the low pressure range), the amount of heat exchange at the cooling portion 133 between the working fluid 120 and the cooling device 113 can be controlled at a predetermined range.

According to the steam engine 110 having the above fluid container 111, the gas-phase working fluid (the steam) 120 can be liquefied at a proper timing, and thereby the decrease of the output energy at the output device 101 can be prevented.

In the above embodiment, the inner radius of the connecting portion 135 is so designed that the value of "ωτ" is set to be more than "10". In the case that the thermal loss is required to be further decreased, the requirement can be achieved by making the value of "ωτ" at a further higher value.

For example, as shown in FIG. 5, if the ratio of the thermal loss is required to be lower than 10%, the inner radius "r2" of the connecting portion 135 is to be so designed that the value of "ωτ" is set to be more than "20". If the ratio of the thermal loss is required to be lower than 5%, the inner radius "r2" of the connecting portion 135 is to be so designed that the value of "ωτ" is set to be more than "30". And furthermore, if the ratio of the thermal loss is required to be lower than 2%, the inner radius "r2", of the connecting portion 135 is to be so designed that the value of "ωτ" is set to be more than "100".

The heating device 112 should not be limited to such a device in which the exhaust gas from the engine is used as the heating source. An electric heating device or a heating device for using gas combustion can be used as the heating device 112.

Second Embodiment

A second embodiment of the present invention is explained with reference to FIGS. 6 to 9, wherein the same reference numerals are used to designate the same or similar portions of the first embodiment.

Figure 6:
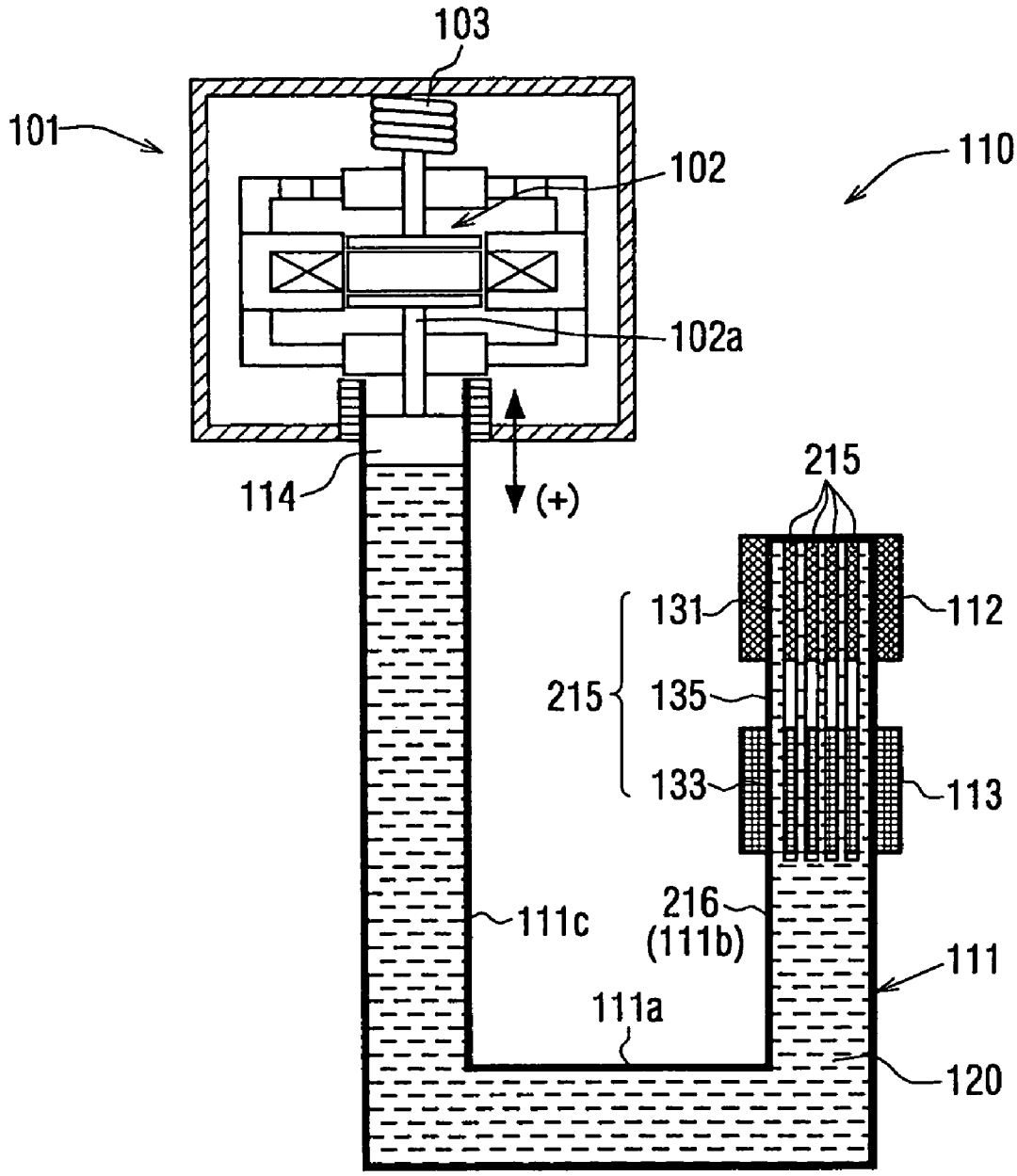
FIG. 6 is a schematic view showing a steam engine according to a second embodiment of the present invention.

In FIG. 6, a heating portion 131, a connecting portion 135 and a cooling portion 133 of a first straight pipe portion 111*b* are formed from multiple small pipe portions 215, and a lower part of the first straight pipe portion 111*b* is formed from a collecting pipe portion 216. Each of the lower ends of the small pipe portions 215 is communicated with the collecting pipe portion 216, whereas each of the upper ends of the small pipe portions 215 is closed.

A heating device 112 and a cooling device 113 are respectively formed to surround the heating portion 131 and the cooling portion 133 of the multiple small pipe portions 215.

Figure 7:
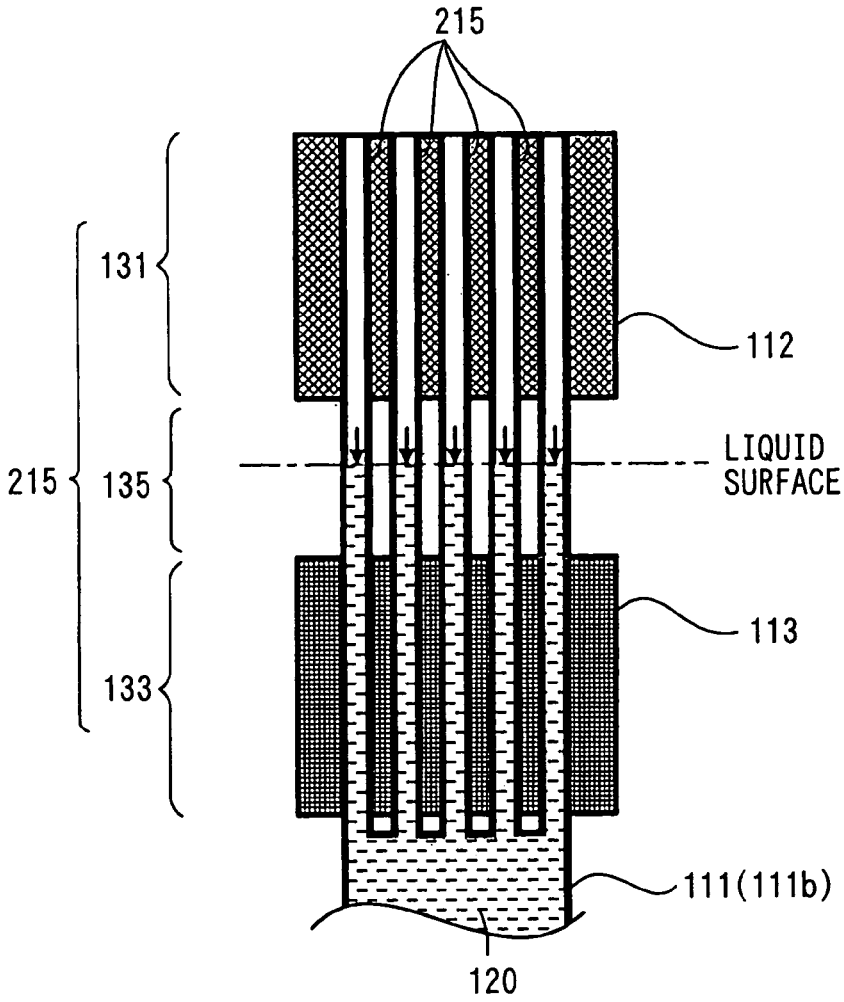
FIG. 7 is a schematic cross sectional view showing a heating and a cooling devices of the second embodiment.

FIG. 7 schematically shows an enlarged cross sectional view of the heating and cooling devices 112 and 113, wherein liquid surfaces of working fluid 120 in the respective small pipe portions 215 are pushed down. Arrows in the respective small pipe portions 215 (in FIG. 7) show directions of pressure of gas-phase working fluid for pushing down the liquid-phase working fluid 120.

When the liquid surface of the liquid-phase working fluid 120 is pushed down, as shown in FIG. 7, the liquid-phase working fluid is moved from the first straight pipe portion 111*b* toward the second straight pipe portion 111*c*, to move a piston 114 upwardly.

When the liquid surface is moved down to the cooling portion 133, and the steam enters into a pipe portion surrounded by the cooling portion 133, the steam is cooled down and liquefied by the cooling device 113. The pressure for downwardly pushing the liquid-phase working fluid in the first pipe portion 111*b* disappears and thereby the liquid surface is moved up in the first pipe portion 111*b* (in a process from the isothermal compression to the adiabatic compression). The piston 114 of a power generator (the output device) 101 is correspondingly moved down.

Since the cooling and heating portions 112 and 113 are formed from the multiple small pipe potions 215, surface areas of those portions to be contacted with the working fluid 120 are increased; surface areas for the heat exchange between the heating/cooling devices 112/113 and the working fluid 120 are increased. The amount of heat exchange is increased and thereby energy transfer effectiveness is increased.

Accordingly, the amount of the heat exchange can be increased, without changing the preset temperatures for the heating and cooling device 112 and 113 (namely without increasing the temperature for the heating device 112 and decreasing the temperature for the cooling device 113).

The output energy from the output device 101 is thus increased as a result of improving the energy transfer effectiveness.

When compared the present embodiment with such a case of a single pipe portion, in which a surface area for the heat exchange is enlarged so that the surface area becomes equal to that of the present embodiment, the solid content of the fluid container 111 of the present invention (having multiple small pipe portions) can be made smaller than that of the single pipe portion.

According to the second embodiment, therefore, the output energy can be increased by increasing the heat exchange efficiency, and at the same time the steam engine 110 can be made in a small size.

In the second embodiment, the exhaust gas of high temperature emitted from the engine is used as heating source (heating fluid) for the heating device 112, wherein the exhaust gas is brought into contact with the heating portion 131 of the fluid container 111 to heat the working fluid 120 in the fluid container 111.

Figure 8:
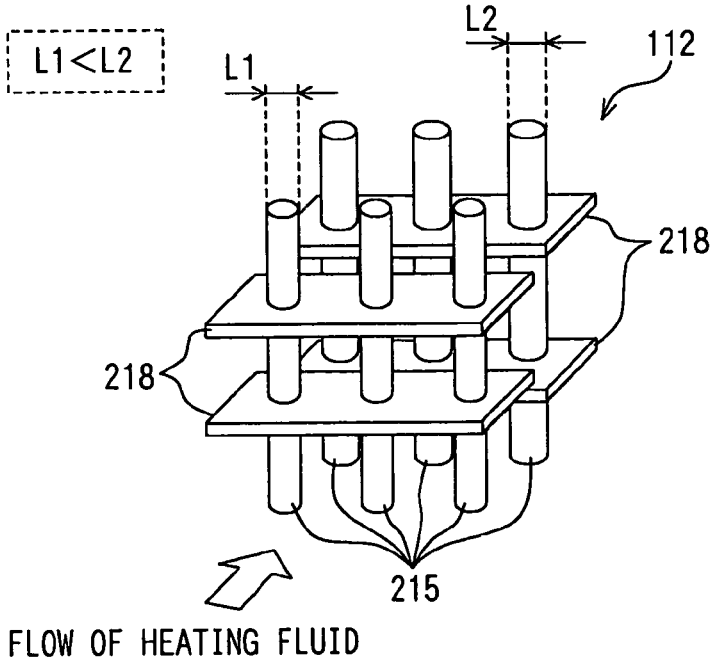
FIG. 8 is a perspective view showing a heating device of the second embodiment.

FIG. 8 shows a perspective view of an inside structure of the heating device 112 and a flow direction of the heating source (exhaust gas).

The heating device 112 comprises a box-shaped casing (not shown) having an inlet and an outlet ports (not shown). The heating device 112 further comprises multiple fins 218 within the casing, wherein multiple through-holes are formed in the fins 218 so that the small pipe portions 215 are inserted through the through-holes. The heating gas (the exhaust gas) flows into the casing through the inlet port and flows through the inside of the casing in a direction indicated by an arrow in FIG. 8.

When the exhaust gas flows in the casing from an upstream side (the inlet port side) toward a downstream side (the outlet port side), the temperature of the exhaust gas is decreased from the upstream to the downstream side, because the heat of the exhaust gas is absorbed by the working fluid in the small pipe portions 215.

Figure 9:
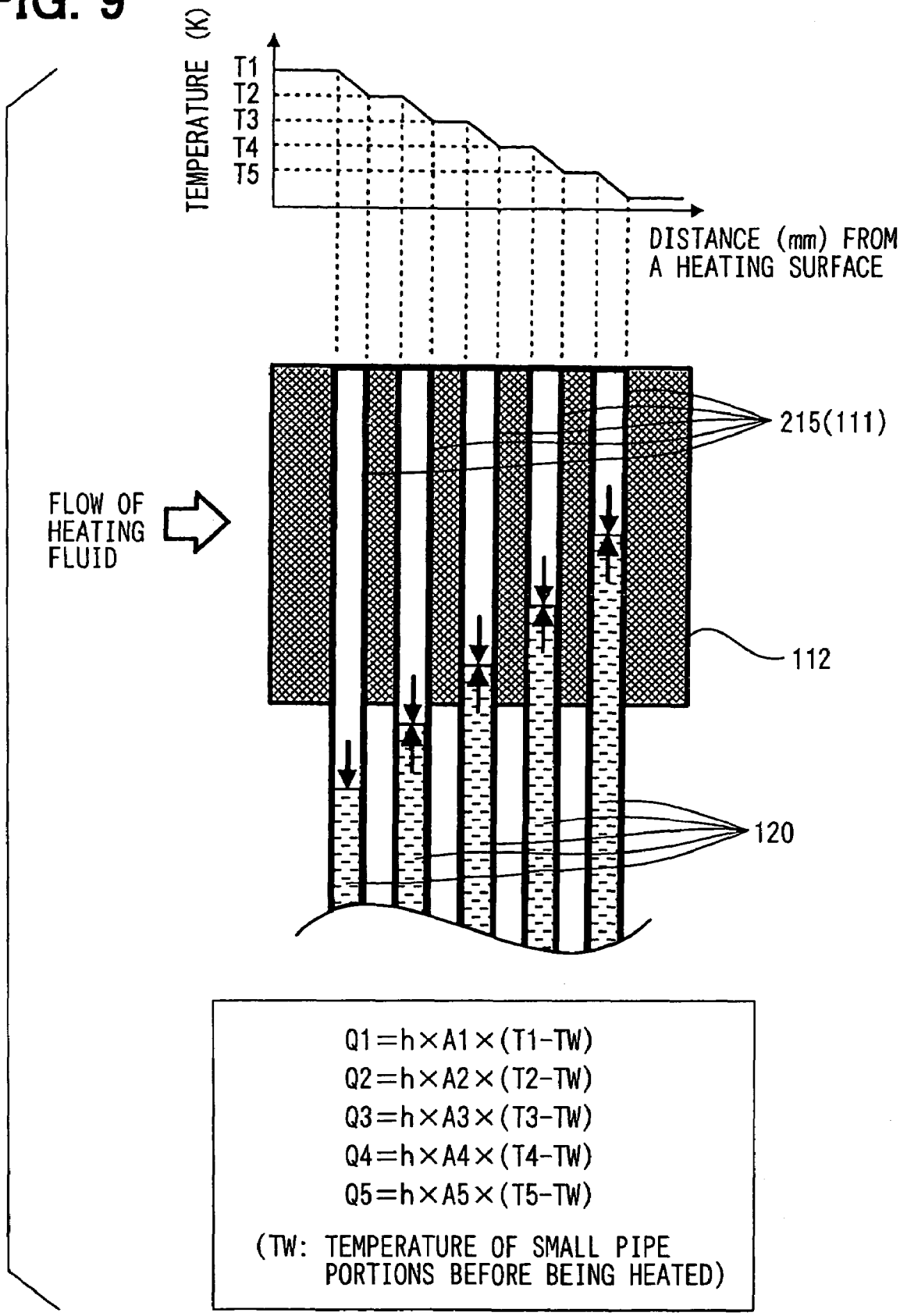
FIG. 9 is a graph showing a temperature change and a cross sectional view of the heating device.

FIG. 9 shows, in its upper portion, a graph showing a temperature change of the exhaust gas with respect to a flow direction (from the upstream to the downstream), and in its lower portion, an enlarged cross sectional view of the heating device 112. In FIG. 9, the multiple small pipe portions 215 are shown as such having the same surface areas to each other.

In case of the heating device 112 shown in FIG. 9, the amount of heat to be absorbed at the small pipe portions 215 of the upstream side differs from that to be absorbed at the small pipe portions 215 at the downstream side. The pressures to be generated in the respective small pipe portions are different and thereby timings of the vaporization in the respective pipe portions are likewise different from each other. In other words, the timings of the fluid pressure increase in the respective pipe portions 215 are different from each other.

When the vaporization timings are different from each other, as in the above heating device of FIG. 9, energy for fluid movement of the working fluid 120 in the small pipe portions 215 having a higher fluid pressure is consumed for decreasing a volume of the gas-phase working fluid in the other small pipe portions 215 having a lower fluid pressure. The energy generated by the vaporization of the working fluid is thereby consumed among the small pipe portions 215 having different inside fluid pressures. The fluid movement may not occur in the bottom pipe portion 111*a* and the second straight pipe portion 111*c*, and the fluid pressure change in the heating device 112 can not be properly transferred to the piston 114.

According to the embodiment of the present invention, as shown in FIG. 8, a diameter "L2" of the small pipe portions 215 at the downstream side of the flow of the exhaust gas is made larger than a diameter "L1" of the small pipe portions 215 at the upstream side (L1<L2), so that surface areas of the downstream pipe portions become larger than that of the upstream pipe portions. The surface areas of the small pipe portions are gradually increased, as the pipe portions are separated from the upstream pipe portions in the direction of the exhaust gas flow, so that the heat collecting performance from the exhaust gas is increased, as the small pipe portions are separated from the upstream pipe portions.

FIG. 9 shows the graph and the cross sectional view of the heating device 112, wherein heat amounts Q1 to Q5 which can be collected at the respective (five different) small pipe portions 215 are indicated by formulas.

In the formulas shown in FIG. 9, "h" is a heat transfer coefficient [W/m2×K] and "TW" is a temperature "K" of the small pipe portions 215 before being heated. "T1" to "T5" are temperatures of the exhaust gas having passed by the respective small pipe portions 215 from the upstream side to the downstream side. "A1" to "A5" are surface areas of the heating portions of the respective small pipe portions 215.

It is necessary to make "Q1" to "Q5" equal to each other, in order to make the heat amounts to be collected from the exhaust gas at the respective small pipe portions almost equal to each other. It is clear that the heat transfer coefficients "h" and the temperatures "TW" of the small pipe portions 215 before being heated are almost equal to each other among those five small pipe portions. And it is also clear that there is a relation among the temperatures "T1" to "T5" of the exhausted gas; T1>T2>T3>T4>T5.

It is, therefore, possible to make "Q1" to "Q5" almost equal to each other, by making the surface areas of the respective small pipe portions to meet such a relation as A1<A2<A3<A4<A5.

According to the embodiment of the present invention, the small pipe portions 215 of the fluid container 111 are so formed that the surface areas of those small pipe portions are gradually increased in the direction from the upstream to the downstream side of the exhaust gas flow.

In the above fluid container 111, the heat collecting performances at the respective small pipe portions 215 are increased from the upstream to the downstream side. As a result, even in the case that the temperature of the exhaust gas is decreased from the upstream to the downstream side, a difference among the heat amounts to be collected at the respective pipe portions 215 can be reduced to a small amount, and a disbalance of the fluid inside pressures among the respective small pipe portions 215 can be minimized.

As above, the fluid container 111 of the steam engine 110 having multiple small pipe portions 215 prevents that the energy is wastefully consumed among the other small pipe portions 215, by reducing the difference of the fluid pressure among the small pipe portions to the small amount. The fluid pressure of the working fluid 120 can be properly applied to the piston 114, and the mechanical energy can be properly obtained at the output device 101.

Third Embodiment

The steam engine 110 according to a third embodiment, in which a communication portion 243 is provided to communicate the small pipe portions 215 with one another, is explained with reference to FIG. 10.

The steam engine 110 differs from the second embodiment (FIGS. 6 to 8) in a structure of a top end portion of the first straight pipe portion 111*b*.

Figure 10:
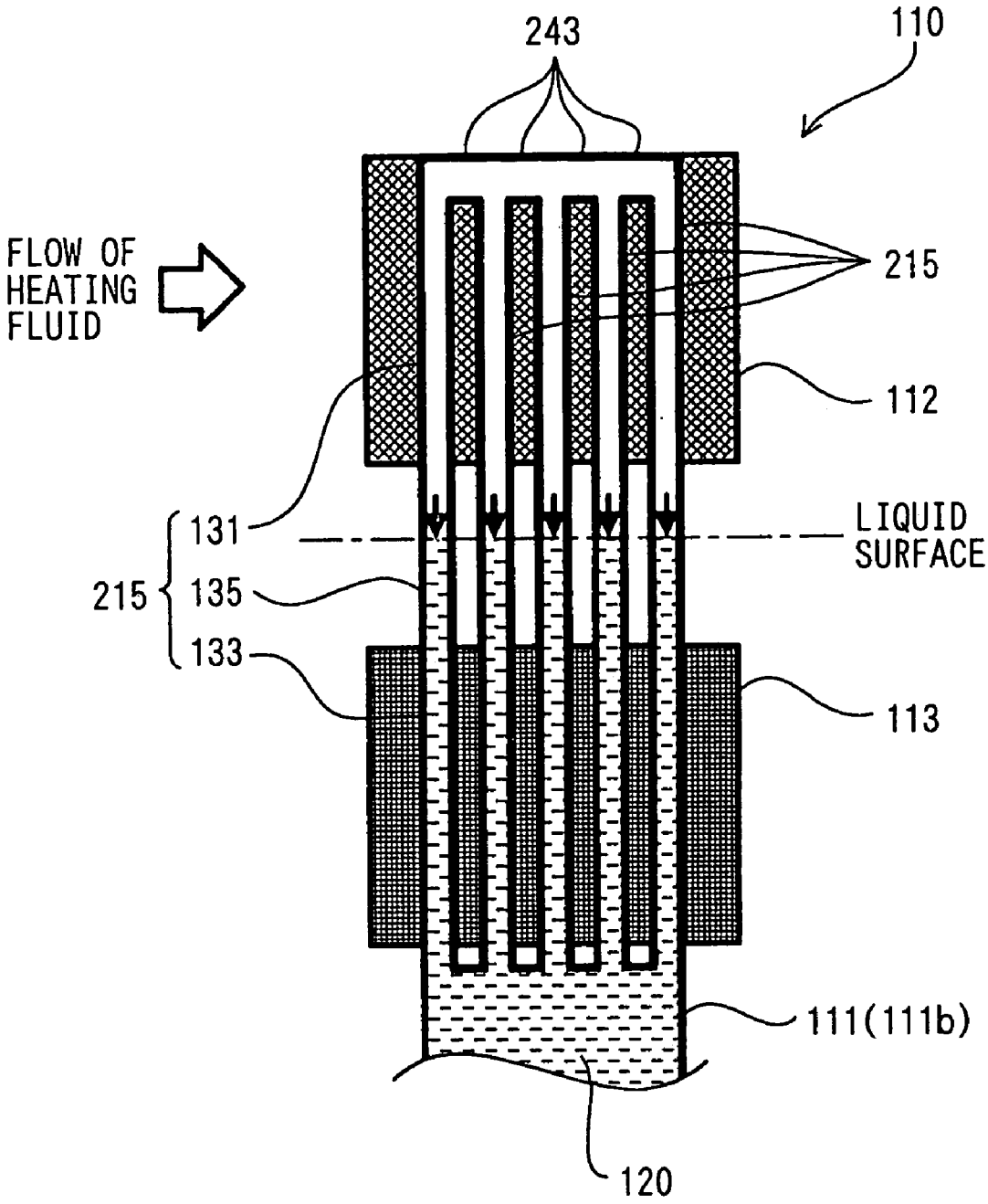
FIG. 10 is a schematic cross sectional view showing a heating and a cooling devices of a third embodiment.

A cross sectional view of the top end portion of the first straight pipe portion 111*b*, the heating device 112, and the cooling device 113 is shown in FIG. 10, wherein the liquid-phase working fluid 120 is pushed down by the fluid pressure of the steam in the fluid container 111.

As shown in FIG. 10, the communication portion 243 is formed at the top end of the fluid container 111 to communicat the small pipe portions 215 (at upper ends of the heating portions 131) with one another, so that an inside space of the communication portion 243 is communicated with all of the inside spaces of the small pipe portions 215.

Since the working fluid (gas-phase) 120 can be moved among the small pipe portions 215, the inside fluid pressure of the respective small pipe portions can be made to equal or substantially equal to each other.

The gas-phase working fluid can move faster than the liquid-phase working fluid, and most of the high pressure gas-phase working fluid is generated at the upper portions of the small pipe portions 215 (at the heating portions 131 of the fluid container 111). The high pressure gas-phase working fluid can be, therefore, moved among the small pipe portions 215 through the communication portion 243.

In the above structure, the pressure difference among the small pipe portions 215 can be immediately eliminated through the communication portion 243, even when evaporation timing (the timing of the pressure increase) in each of the small pipe portions 215 is different from others.

Modifications of the Second & Third Embodiments

Various kinds of modifications of the above embodiments can be possible.

Figure 11:
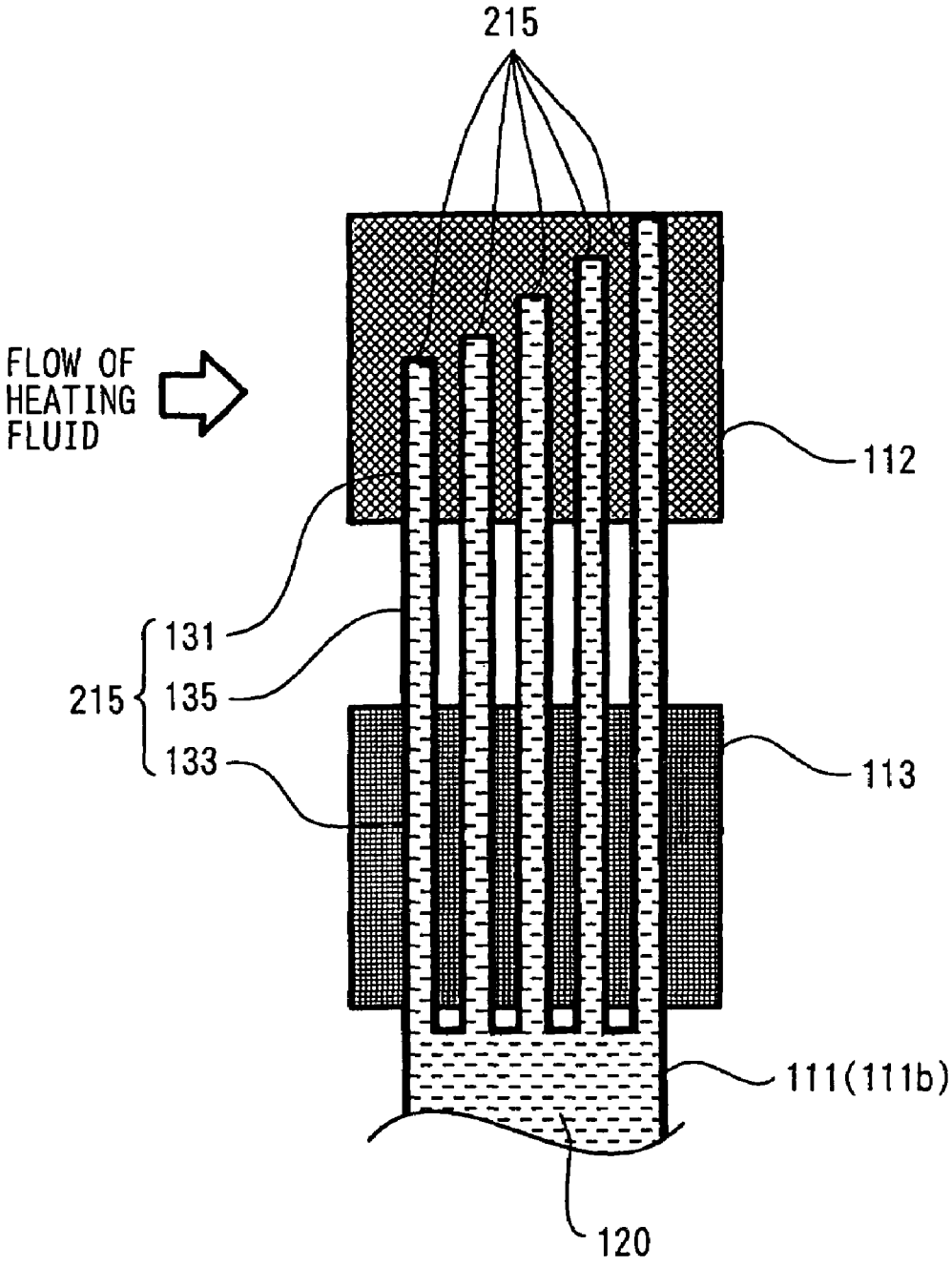
FIGS. 11 to 14 are schematic cross sectional views, respectively showing a heating and a cooling devices of modifications of the third embodiment.

In a steam engine shown in FIG. 11, a length of the heating portion 131 of the small pipe portions 215 is made longer, as a distance of the small pipe portion 215 from the upstream side of the heating device 112 becomes longer. The surface area of the heating portion 131 is increased from the upstream to the downstream side of the heating device 112.

Figure 12:
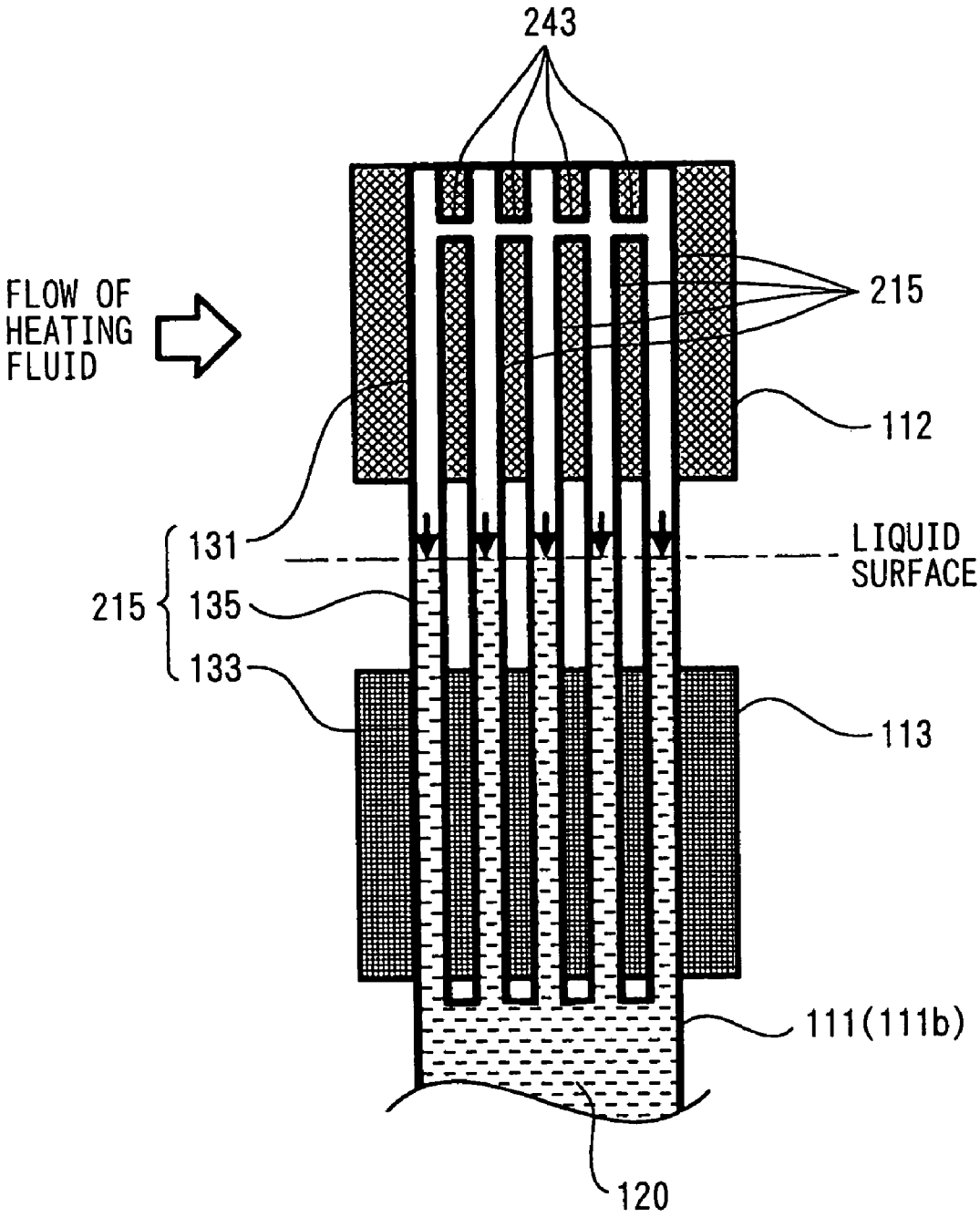

The communication portion 243 is not necessarily provided at the top ends of the small pipe portions 215, but can be provided at any other portions of the heating portions 131, as shown in FIG. 12.

Figure 13:
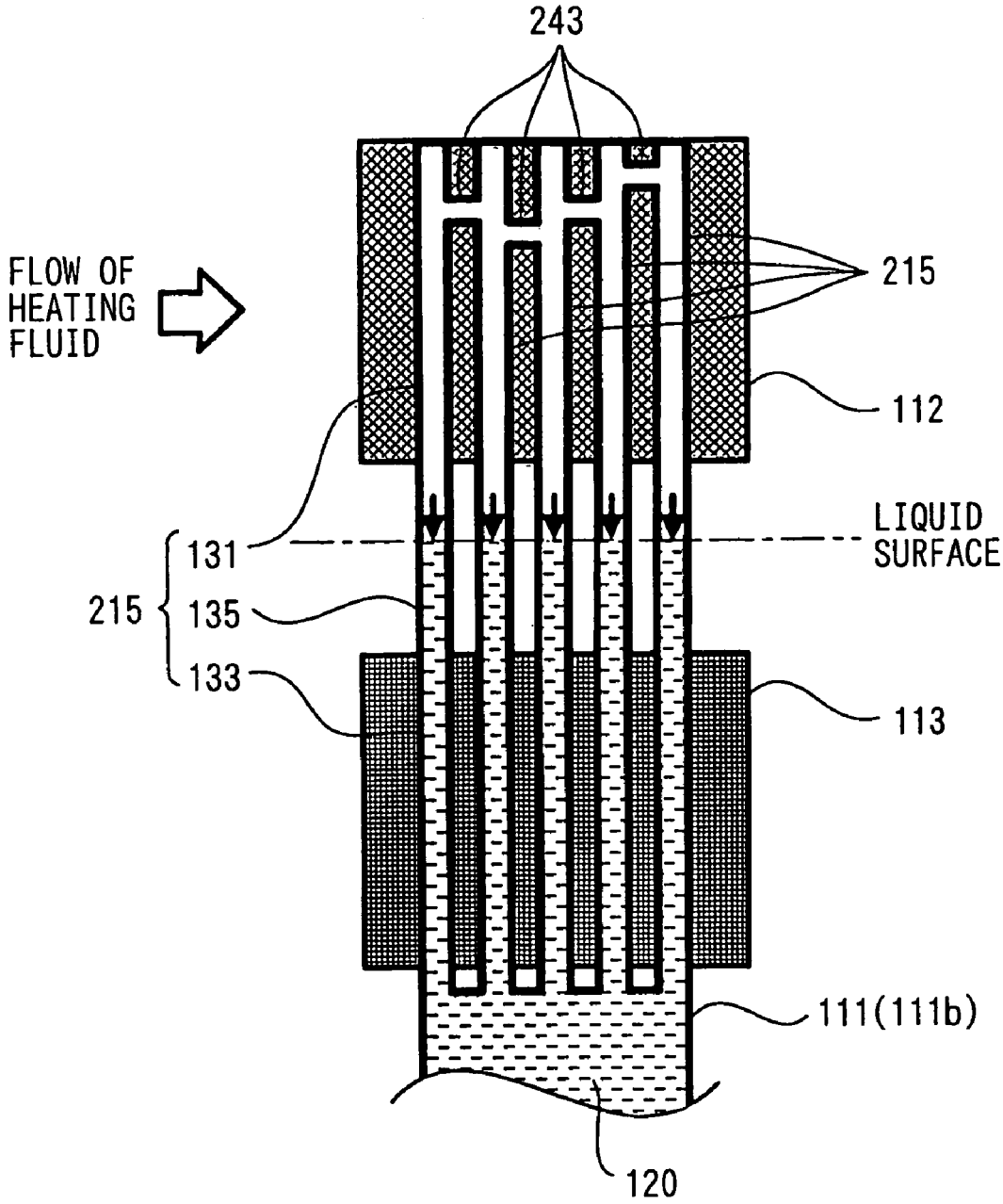

Furthermore, the communication portion 243 is not necessarily provided at the same height of the heating portions 131, but can be provided at different heights in the small pipe portions 215, as shown in FIG. 13.

Figure 14:
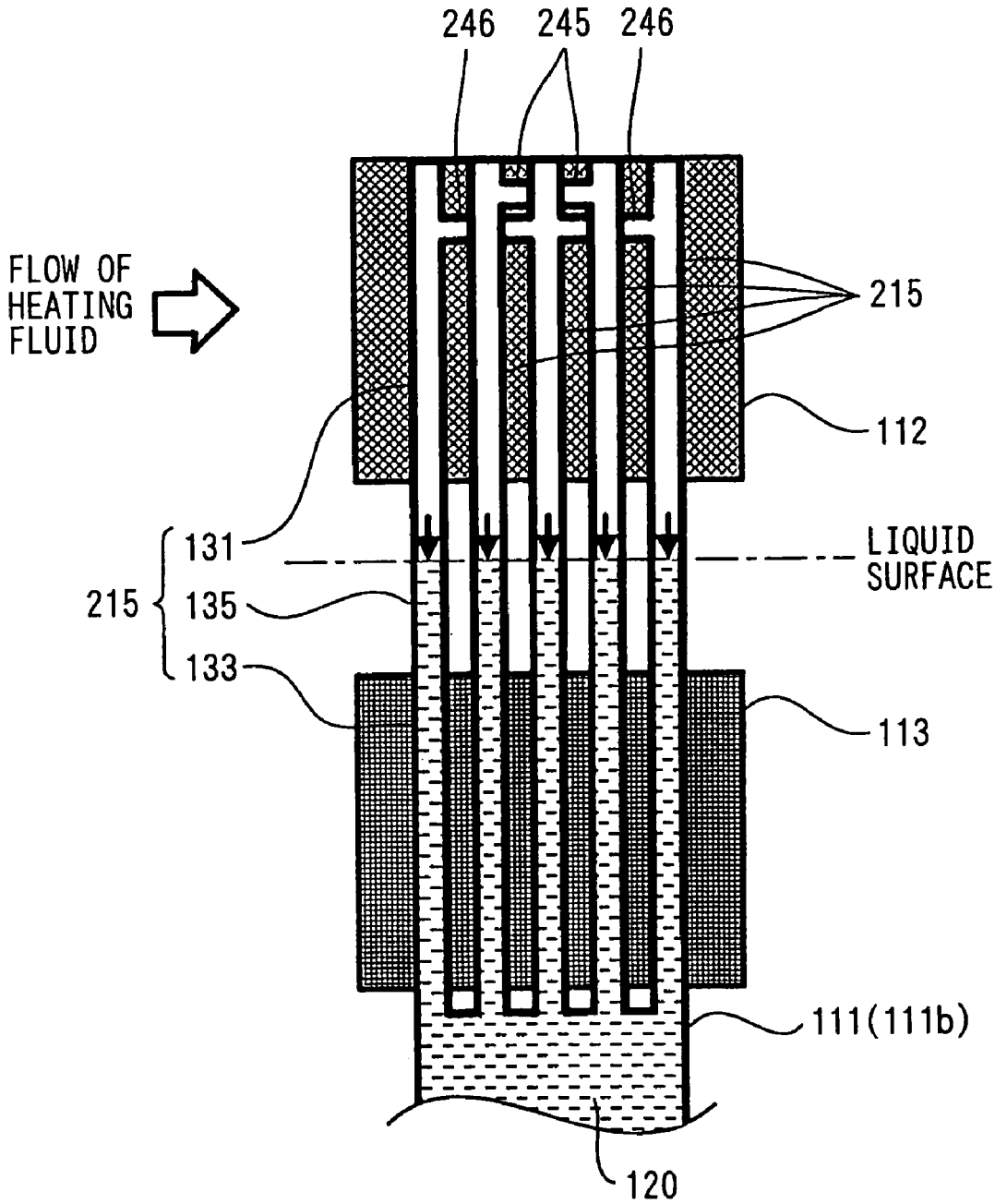

Furthermore, the communication portion 243 is not necessarily provided to communicate all of the small pipe portions 215 with one another, but can be provided to communicate one group of the small pipe portions with one another and to communicate the other group of the small pipe portions with one another, independently from the first group of the small pipe portions, as shown in FIG. 14.

In FIG. 14, a first communication portion 245 communicates the second and fourth small pipe portions with each other, whereas a second communication portion 246 communicates the first, the third and fifth small pipe portions with one another.

According to the experiments by the present inventors, it is confirmed that an average fluid pressure in the above first group (245) of the small pipe portions is almost equal to an average fluid pressure in the second group (246) of the small pipe portions.

The heating device 112 is not limited to the above described heating device, to which the heating gas from the outside heating source (such as the internal combustion engine) is supplied, but can be comprised of an electric heater or a gas burner. In such a modified steam engine, the respective small pipe portions of the heating device can be independently heated to reduce variation of heat amount to be supplied to the respective small pipe portions.

The heating device 112 and the cooling device 113 can be arranged to be close to each other, without the connecting portions. The number of the small pipe portions is not limited to five.

Fourth Embodiment

Figure 15:
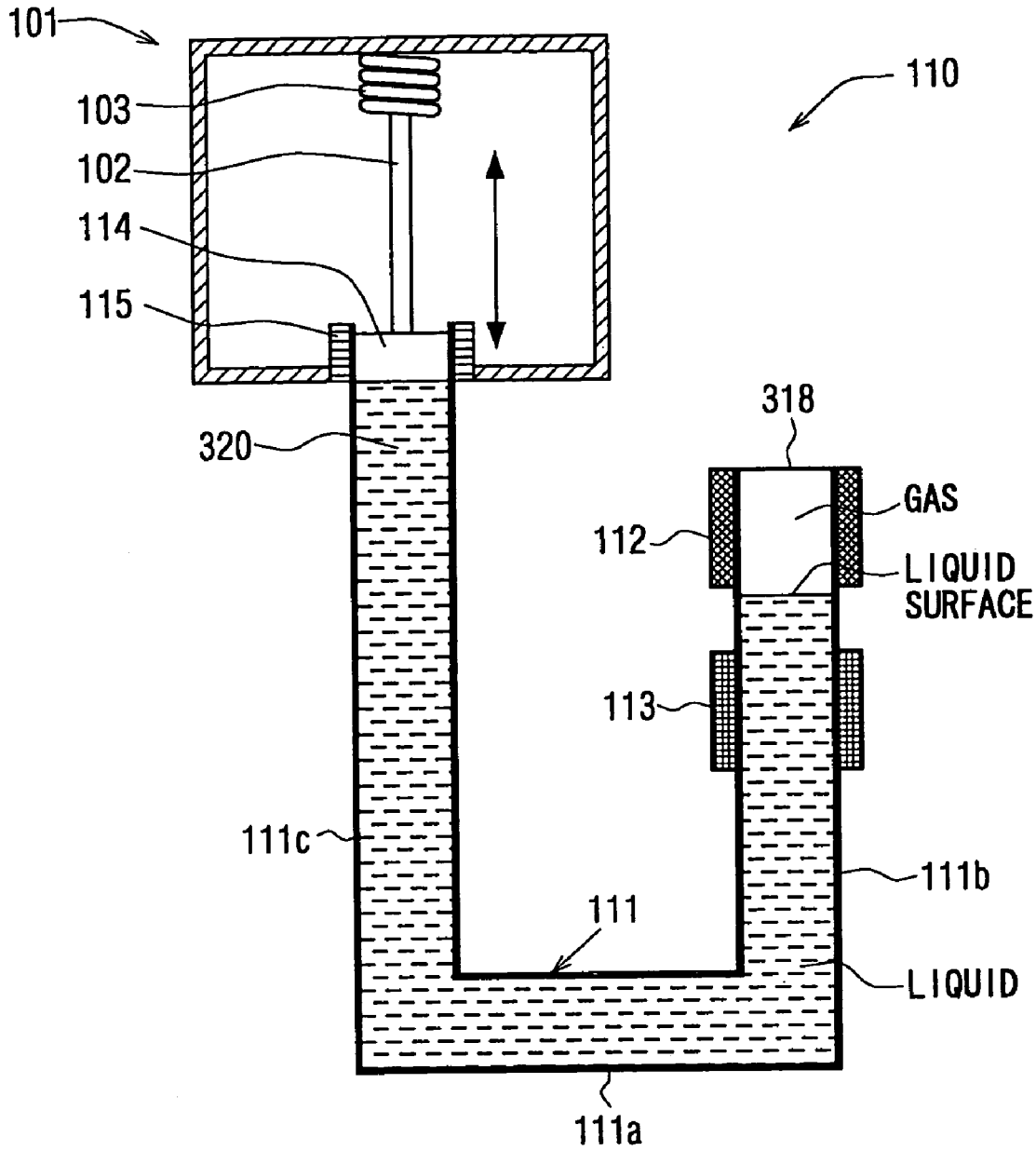
FIG. 15 is a schematic view showing a steam engine according to a fourth embodiment of the present invention.

A fourth embodiment of the present invention is explained with reference to FIGS. 15, 16A and 16B.

Figure 16A:
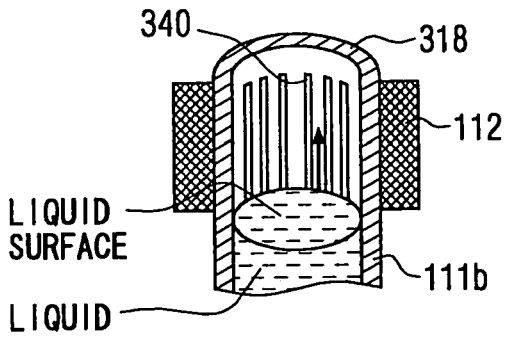
FIGS. 16A and 16B are perspective views showing a heating device of the fourth embodiment shown in FIG. 15.
Figure 16B:
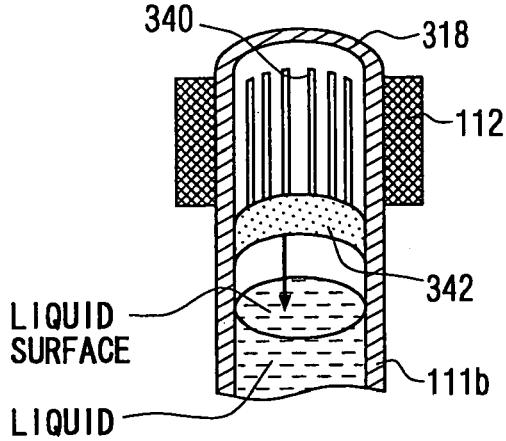

The first straight pipe portion 111*b* at the heating device 112 will be explained with reference to FIGS. 15, 16A and 16B, wherein FIGS. 16A and 16B show an inside structure of the heating portion (112), which is arranged at the top end 318 of the first straight pipe portion 111*b*.

Multiple narrow grooves 340 are formed at an inner surface of the heating portion (112) of the pipe portion 111*b*. The narrow grooves 340 longitudinally extend toward the cooling portion (113) of the pipe portion 111*b*. The narrow grooves 340 are so formed to cause capillary phenomenon by the liquid-phase working fluid in the pipe portion 111*b*. A water-repellant surface 342 is formed at the inner surface of the pipe portion 111*b* at such a position between the heating portion (112) and the cooling portion (113) of the pipe portion 111*b* (at a lower end of the narrow grooves 340).

In the steam engine 110 of the fourth embodiment, a gas is filled in the first straight pipe portion 111*b*, so that the inside space of the heating portion (112) is not filled with the liquid-phase working fluid.

As in the same manner to the first embodiment, the piston 114 is movably held in the cylinder 115. The piston 114 is upwardly moved to its top dead center when the fluid pressure in the fluid container 111 is increased, whereas the piston 114 is downwardly moved to its bottom dead center when the fluid pressure is decreased.

The liquid surface of the liquid-phase working fluid in the first straight pipe portion 111*b* is upwardly moved, when the piston 114 is downwardly moved. And when the piston 114 reaches at its bottom dead center, the liquid surface in the first pipe portion 111*b* comes to its highest position.

According to the present embodiment, when the liquid surface comes to the highest position in the first pipe portion 111*b*, the liquid surface reaches at the lower ends of the narrow grooves 340, as shown in FIG. 16A.

The liquid-phase working fluid is then supplied to the inner surface of the heating portion (112) through the narrow groves 340 due to the capillary phenomenon. The working fluid is then heated and vaporized by the heating device 112, and the volumetric expansion of the working fluid by the vaporization is generated in the fluid container 111.

The liquid surface of the working fluid is pushed down to a position, which is lower than the water-repellant surface 342, as shown in FIG. 16B. The liquid surface at an upper end 320 of the second straight pipe portion 111*c* is thereby pushed up. The piston 114 and the moving member 102 of the output device 101 are upwardly moved.

A lower part of the gas-phase working fluid is further downwardly moved by the volumetric expansion of the vaporization, and comes into the space of the cooling portion of the cooling device 113.

The gas-phase working fluid is cooled down and liquefied at the cooling portion (113), and the working fluid in the fluid container 111 is volumetrically contracted.

The liquid surface in the first straight pipe portion 111*b* moves up due to the volumetric contraction of the working fluid, and the liquid surface in the second straight pipe portion 111*c* is thereby downwardly moved. The piston 114 as well as the moving member 102 is pushed downwardly by the spring force of the spring 103. When the piton 114 is moved to its bottom dead center, the liquid surface in the first straight pipe portion 111*b* moves up to the narrow grooves 340 (FIG. 16A).

The above volumetric expansion and contraction are repeated to reciprocate the piston 114 and the moving member 102, so that electric power is generated.

In the above steam engine 110, the highest position of the liquid surface in the first straight pipe portion 111*b* is at the lower position of the narrow grooves 340, and the liquid-phase working fluid to be heated by the heating device 112 is only the working fluid which is supplied to the inner surface of the heating portion (112) through the narrow grooves 340. The liquid-phase working fluid at the heating portion (112) is thereby fully vaporized.

As above, the amount of the liquid-phase working fluid, which is heated but not vaporized by the heating device 112, is minimized. Namely, the thermal loss is minimized.

Since the water-repellant surface 342 is formed at the lower portion of the narrow grooves 340, the movement of the working fluid (the self-excited vibration of the working fluid) in the fluid container 111 can be more properly performed.

When the liquid surface is pushed down in the first straight pipe portion 111*b* by the vaporization of the working fluid, the liquid surface is further moved by the water-repellant surface 342 to the position lower than the water-repellant surface 342 (FIG. 16B).

When the liquid surface is pushed down as above, there is the water-repellant surface 342 between the narrow grooves 340 and the liquid surface. Therefore, the liquid-phase working fluid is prevented from going up to the heating portion (112) through the narrow grooves 340 by the capillary phenomenon.

In the case that the liquid-phase working fluid remaining in the narrow grooves 340 at the heating portion (112) is continuously heated and vaporized even after the liquid surface has been pushed down, the stable operation of the self-excited vibration of the working fluid can not be possible. However, according to the present embodiment, the continuous vaporization of the liquid-phase working fluid is prevented by the water-repellant surface 342.

The structure of the inner surface of the heating portion (112) is not limited to the multiple narrow grooves 340 of FIG. 16A.

Figure 17:
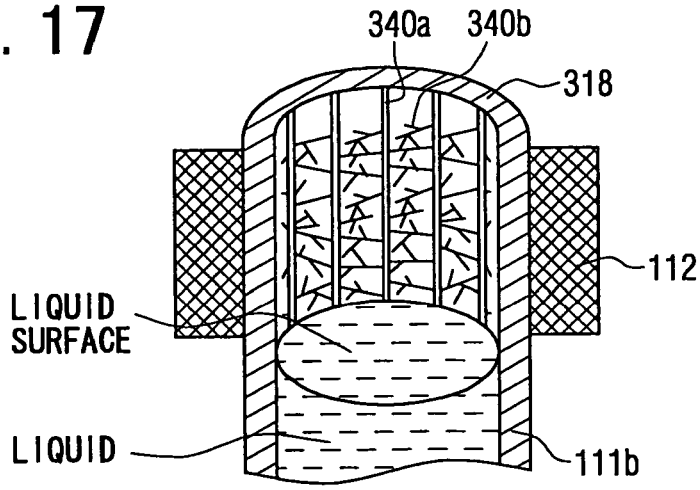
FIGS. 17 and 18 are perspective views showing a heating device according to a modification of the fourth embodiment.

FIG. 17 shows a modification of the structure of the inner surface of the heating portion. In FIG. 17, multiple narrow grooves 340*a* are formed in the inner surface of the first straight pipe portion 111*b*, vertically extending at the heating portion as in the same manner to those in FIG. 16A. In addition, a large number of micro grooves 340*b*, which are branched off from the narrow grooves 340*a*, is formed in the inner surface. The surface areas of the narrow grooves 340*a* and the micro grooves 340*b* are thus increased, so that a relatively large amount of the liquid-phase working fluid can be supplied to the heating portion (112).

Since the amount of the liquid-phase working fluid, namely the amount of the gas-phase working fluid by the vaporization, can be increased, the output of the steam engine 110 can be correspondingly increased.

The narrow groves 340 (340*a*), which are regularly formed at the inner surface, can be formed by a machining process or a chemical treatment, such as an etching process. The micro grooves 340*b*, which are irregularly formed at the inner surface, can be likewise formed by the chemical treatment, such as an etching process, so that the inner surface is roughened. The micro grooves 340*b* can be alternatively formed by forming irregular micro convex surfaces, in which metal separation is formed by dipping the pipe portion 111*b* into electrolytic solution.

Figure 18:
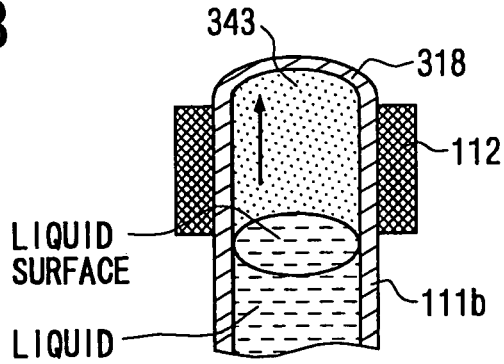

A water-attracting surface 343 can be formed at the inner surface of the heating portion (112), instead of the narrow grooves 340 (340*a*) and the micro grooves 340*b*, as shown in FIG. 18.

The water-attracting surface 343 can be, for example, formed by the following methods:

(1) A coating layer is formed by a water-attracting ceramic materials, such as $CaF_2$, CaO, MgO, $Al_2O_3$, BeO, ZnO, $TiO_2$, $SiO_2$, $SnO_2$, $Cu_2O$, $Na_2S$, $B_2O_2$, CaS, CuO, etc.

In case that a coating layer is formed by the water-attracting ceramic material of $SiO_2$ (glass) and the heating portion of the first pipe portion 111*b* is made of aluminum, the coating layer can be formed in such a way that the heating portion (on which the liquid glass is adhered) is heated.

(2) A hydrophilic group, such as hydroxyl group (—OH group), carboxyl group (—COOH group) is combined.

(3) Sintered metal material or diffusion bonding material of foamed metal is adhered to the inner surface of the heating portion (112) of the pipe portion 111*b*, in case the pipe portion 111*b* is made of metal, such as cupper. The adhered material is preferably the same raw material to that of the pipe portion 111*b*.

(4) In the case that the pipe portion 111*b* is made of the sintered material of carbon, (—Si—O—H group) is combined to the inner surface of the pipe portion 111*b*.

The above water-attracting surface 343 can be also formed on the surfaces of the narrow grooves 340 (340*a*) and the micro grooves 340*b*, so that the supply of the liquid-phase working fluid to the heating portion (112) can be done more quickly. The response of the steam engine 110 is increased, namely a frequency of the self-excited vibration of the working fluid in the fluid container 111 can be sifted to a higher frequency range.

A fluid having a lower surface tension than the water, such as ethanol, can be used as the working fluid, so that the supply of the liquid-phase working fluid to the heating portion (112) can be quickly done. A detergent can be mixed to the water to decrease the surface tension, in case of using the water as the working fluid.

Fifth Embodiment

A fifth embodiment of the present invention is explained with reference to FIGS. 19A, 19B to 21.

Figure 19A:
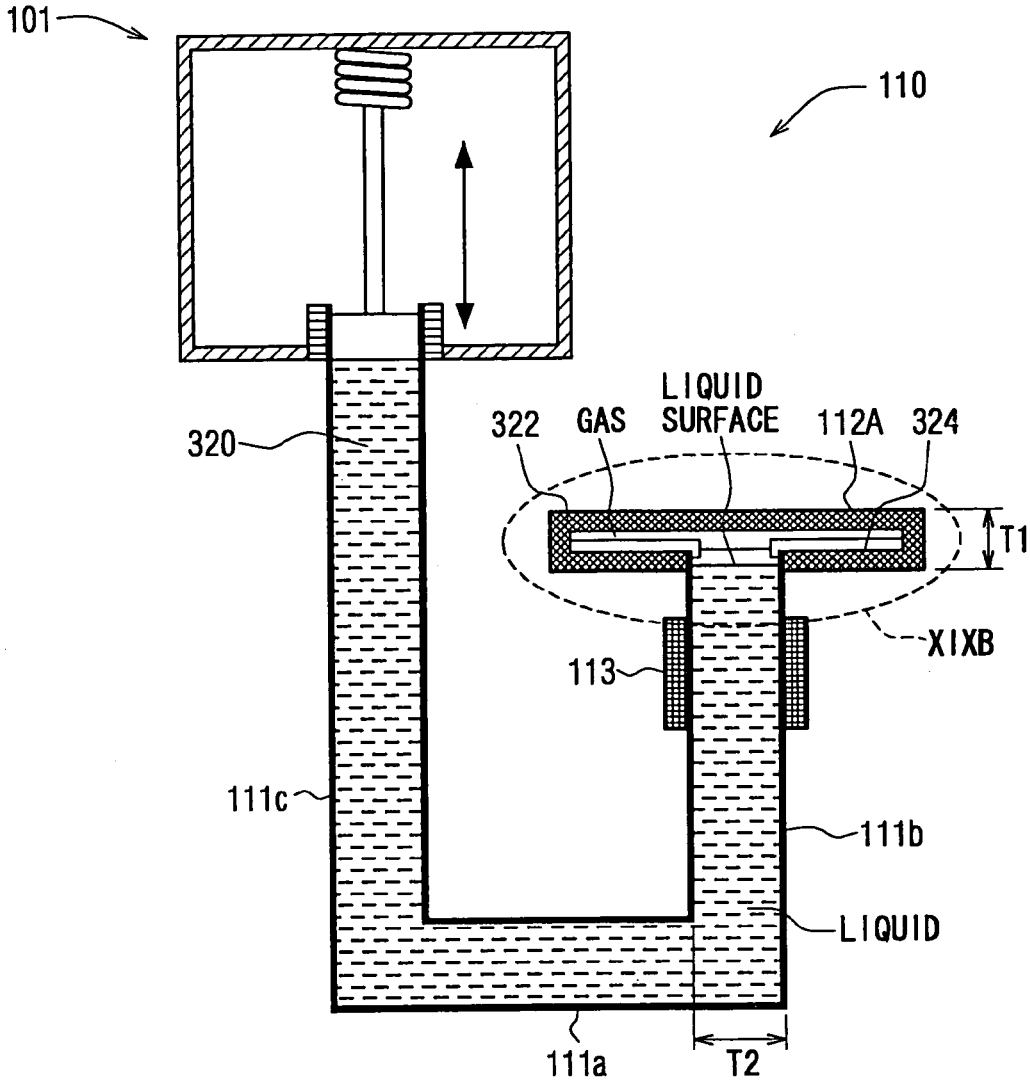
FIG. 19A is a schematic view showing a steam engine according to a fifth embodiment of the present invention.
Figure 19B:
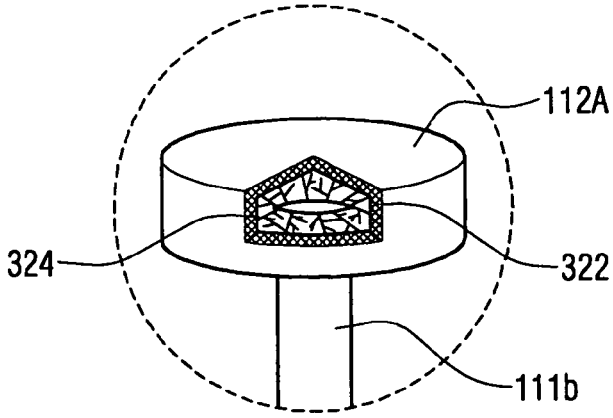
FIG. 19B is a perspective view showing a heating device according to the fifth embodiment shown in FIG. 19A.
Figure 20A:
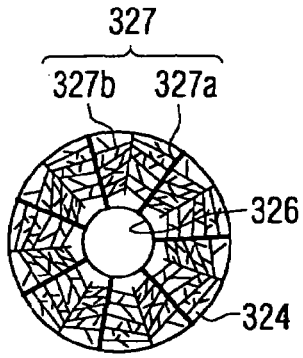
FIGS. 20A and 20B are plan views showing a part of the heating device of the fifth embodiment
Figure 20B:
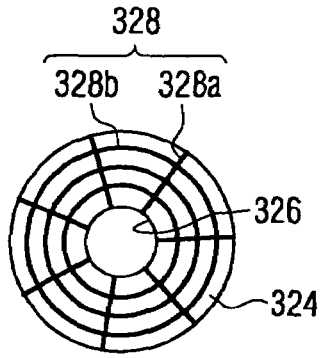

FIG. 19A shows a schematic view of the steam engine 110 of the fifth embodiment, FIG. 19B shows an enlarged perspective view of a heating device 112A circled by a dotted line in FIG. 19A, and FIGS. 20A and 20B are top plan views showing the heating portion of the heating device 112A.

The fifth embodiment differs from the above fourth embodiment, in that the heating portion of the heating device 112A is formed by a disc shaped hating portion 322, which is provided at the top end of the first straight pipe portion 111*b* and has a disc shaped inner surface 324 horizontally extending. The heating device 112A is provided at an outer periphery of the heating portion 322.

In the fifth embodiment, a vertical thickness "T1" of the heating device 112A is made smaller to increase the thermal efficiency of the steam engine 110, by minimizing the amount of the working fluid to be heated and vaporized at the heating device 112A. For example, the thickness "T1" is made smaller than a diameter "T2" of the first straight pipe portion 111*b*, as shown in FIG. 19A.

As shown in FIG. 20A, multiple narrow grooves 327*a*, which extend (regularly) outwardly in radial directions from a center opening 326 communicated with the top end of the first straight pipe portion 111*b*, are formed at the inner surface 324. Multiple micro grooves 327*b* are further formed (irregularly) at the inner surface 324. The narrow grooves 327*a* and the microgrooves 327*b* are so formed to cause capillary phenomenon by the liquid-phase working fluid in the pipe portion 111*b*. The narrow grooves 327*a* and the microgrooves 327*b* can be formed by the machining process and chemical etching process, as in the same manner to the above fourth embodiment.

The structure of the grooves (327*a* and 327*b*) to be formed at the inner surface 324 is not limited to that shown in FIG. 20A. For example, the structure of the grooves can be made as shown in FIG. 20B, in which narrow grooves 328 are regularly formed. The narrow grooves 328*a* extend outwardly in the radial directions from the center opening 326, whereas the narrow groves 328*b* are formed as concentric circles having different diameters to the center opening 326.

In the steam engine 110 of the fifth embodiment, a gas is filled in the heating portion 322, so that the inside space of the heating portion is not filled with the liquid-phase working fluid.

When the piston 114 is moved to its bottom dead center, the liquid surface in the first straight pipe portion 111*b* is moved to its highest position, at which the center opening 326 is filled with the working fluid.

The liquid-phase working fluid is spread over the inner surface 324 through the narrow grooves 327 (328) due to the capillary phenomenon. The working fluid is heated and vaporized by the heating device 112A, to cause the volumetric expansion of the working fluid in the fluid container 111.

Since the narrow grooves 327 (328) formed in the heating portion 322 extends horizontally, the supply speed of the liquid-phase working fluid through the grooves 327 (328) becomes higher than the steam engine of the fourth embodiment (FIGS. 15 to 18), because the horizontal movement of the liquid-phase working fluid is little influenced by the gravity. The response of the steam engine 110 is accordingly increased.

Figure 21:
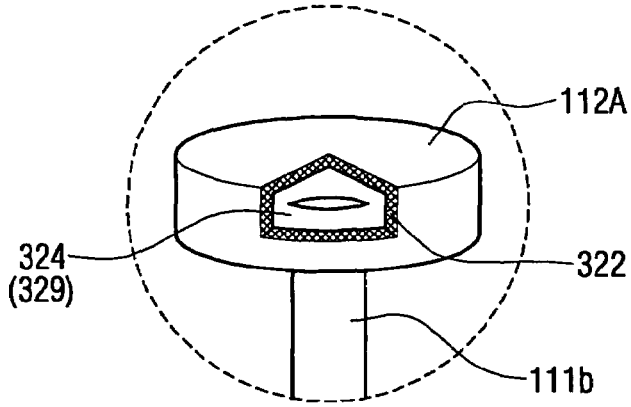
FIG. 21 is a perspective view showing a heating device according to a modification of the fifth embodiment.

A water-attracting surface 329 can be formed at the inner surface 324 of the heating portion, instead of the narrow grooves 327 (328), to facilitate the supply of the working fluid to the heating portion, as shown in FIG. 21. The water-attracting surface can be formed as in the same manner to the fourth embodiment.

The water-attracting surface 329 can be further formed at surfaces of the narrow grooves 327 and 328, to further increase the supply speed of the working fluid.

Sixth Embodiment

A sixth embodiment of the present invention is explained with reference to FIG. 22.

Figure 22:
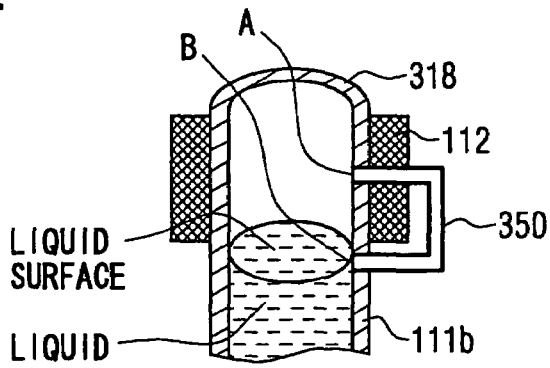
FIG. 22 is a perspective view showing a part of steam engine according to a sixth embodiment of the present invention.
Figure 23:
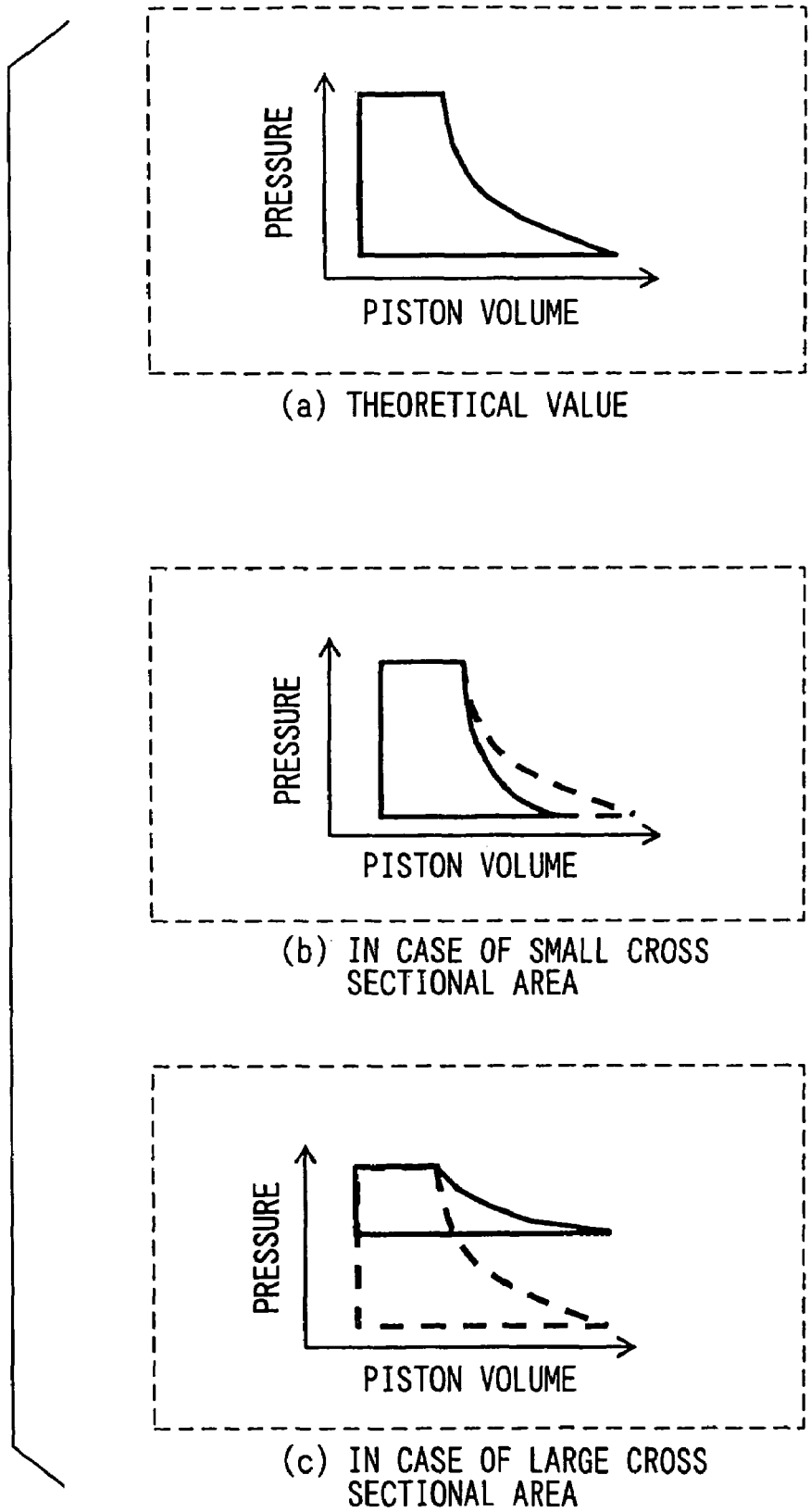
FIGS. 23A, 23B and 23C are p-v diagrams showing a relation between a fluid pressure and a volume of working fluid.
Figure 24:
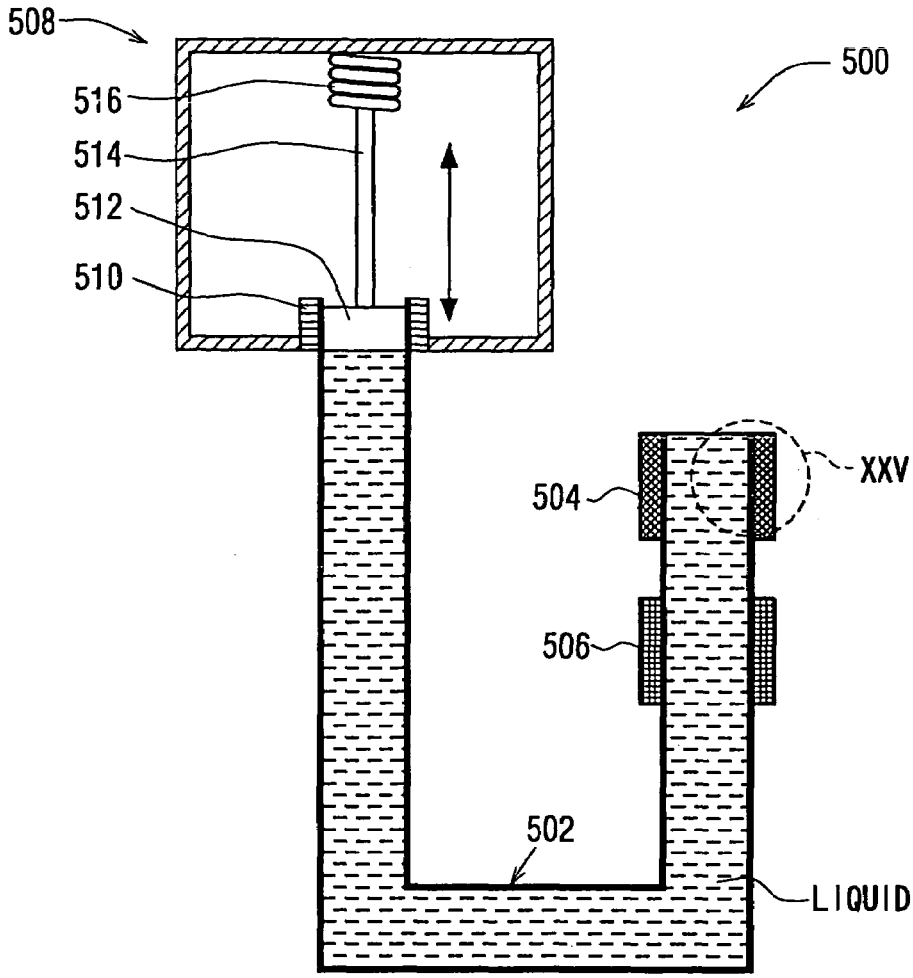
FIG. 24 is a schematic view showing a steam engine according to a related art.
Figure 25:
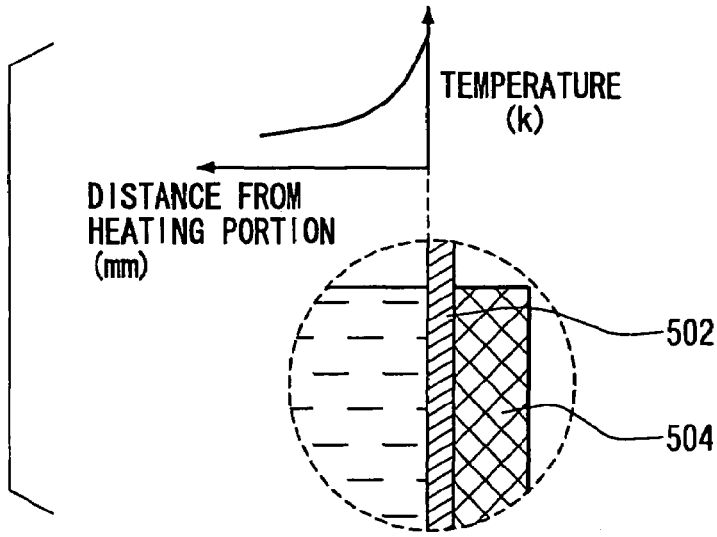
FIG. 25 is an enlarged view showing a heating device of FIG. 24.

FIG. 22 is a modification of the fourth embodiment (FIGS. 15 to 18) and shows an upper portion of the first straight pipe portion 111*b*. The sixth embodiment is different from the fourth embodiment in that a branch pipe 350 is provided at the upper portion of the first straight pipe portion 111*b*, wherein an upper end of the branch pipe 350 is connected to a part "A" of the heating portion (112) and connected at its lower end to a part "B" of the straight pipe portion, which is lower than the heating device 112. An inner diameter of the branch pipe 350 is so designed that the liquid-phase working fluid is supplied to the heating portion (the part A) by the capillary phenomenon.

In the steam engine 110 of the sixth embodiment, a gas is filled in the heating portion (112), so that the inside space of the heating portion is not filled with the liquid-phase working fluid.

When the piston provided at the second straight pipe portion is moved to its bottom dead center, the liquid surface in the first straight pipe portion 111*b* is at such a position slightly higher than the part "B" of the branch pipe 350, so that the liquid-phase working fluid is supplied upwardly to the heating portion (112) through the branch pipe 350 due to the capillary phenomenon.

According to the sixth embodiment, the amount of the liquid-phase working fluid, which is heated and vaporized at the heating device 112, is limited to such an amount of the working fluid supplied to the heating portion through the branch pipe 350. The liquid-phase working fluid is thereby fully vaporized.

As above, the amount of the working fluid, which is heated but not vaporized and moved toward the cooling device, can be minimized, so that the thermal loss can be minimized.

Narrow grooves (340) and/or water-attracting surface (343) can be formed at the inner surface of the branch pipe 350.

What is claimed is:

1. A steam engine comprising:

a fluid container in which working fluid is filled and the working fluid can move;

a heating device for heating the working fluid in the fluid container and vaporizing the working fluid to produce steam;

a cooling device for cooling down and liquefying the steam vaporized by the heating device; and an output device having a moving member reciprocating by pressure change of the working fluid in the fluid container, and outputting energy converted from the reciprocal movement of the moving member, wherein the fluid container comprises a pipe shaped portion having a heating portion at which the heating device is provided, and a cooling portion at which the cooling device is provided, wherein an inner radius "r1" of the cooling portion is made to almost equal to a depth "δ1" of thermal penetration (at a low pressure), which is calculated by the following formula (1);

$$\delta_1 = \sqrt{\frac{2a_1}{\omega}} \tag{1}$$

"a1" is a heat diffusivity of the working fluid at its low pressure, and

"ω" is an angular frequency of the movement of the working fluid in the fluid container, and wherein the heat diffusivity "a1" is selected from those values corresponding to a pressure variable range of the working fluid, which is a range of the fluid pressure from the lower limit to a fluid pressure higher than the lower limit by 25%.

2. A steam engine according to claim 1, wherein the heat diffusivity "a1" is a value, when the fluid pressure is at the lower limit.

3. A steam engine according to claim 1, wherein the fluid container further comprises a connecting portion for connecting the heating portion with the cooling portion, wherein an inner radius "r2" of the connecting portion is made to satisfy the following formulas (2) and (3);

$$\frac{(r_2)^2}{2 \cdot a_2} = \tau \quad (2)$$

$$\omega \cdot \tau \geq 10 \quad (3)$$

"a2" is a heat diffusivity of the working fluid at its high pressure, and

"ω" is an angular frequency of the movement of the working fluid in the fluid container.

4. A steam engine according to claim 3, wherein the inner radius "r2" of the connecting portion is equal to, or almost equal to, the inner diameter "r1" of the cooling portion.

5. A steam engine according to claim 3, wherein the inner radius "r2" of the connecting portion, the inner diameter "r1" of the cooling portion, and an inner radius of the heating portion are equal to, or almost equal to, each other.

6. A steam engine comprising:

a fluid container in which working fluid is filled and the working fluid can move;

a heating device for heating the working fluid in the fluid container and vaporizing the working fluid to produce steam;

a cooling device for cooling down and liquefying the steam vaporized by the heating device; and an output device having a moving member reciprocating by pressure change of the working fluid in the fluid container, and outputting energy converted from the reciprocal movement of the moving member, wherein the fluid container comprises a pipe shaped portion having a heating portion at which the heating device is provided, a cooling portion at which the cooling device is provided, and a connecting portion for connecting the heating portion with the cooling portion, wherein an inner radius "r2" of the connecting portion is made to satisfy the following formulas (2) and (3);

$$\frac{(r_2)^2}{2 \cdot a_2} = \tau \quad (2)$$

$$\omega \cdot \tau \geq 10 \quad (3)$$

"a2" is a heat diffusivity of the working fluid at its high pressure, and

"ω" is an angular frequency of the movement of the working fluid in the fluid container.

7. A steam engine according to claim 6, wherein the inner radius "r2" of the connecting portion is equal to, or almost equal to, the inner diameter "r1" of the cooling portion.

8. A steam engine according to claim 6, wherein the inner radius "r2" of the connecting portion, the inner diameter "r1" of the cooling portion, and an inner radius of the heating portion are equal to, or almost equal to, each other.

* * * * *